US005689759A

United States Patent [19]

Isemura et al.

[11] Patent Number: 5,689,759

[45] Date of Patent: Nov. 18, 1997

[54] COPYING APPARATUS AND SHEET SIZE DETECTING DEVICE ADAPTED FOR USE THEREIN

[75] Inventors: Keizo Isemura, Kokubunji; Hideki Adachi, Kawasaki; Tokuharu Kaneko, Yokohama; Satoru Kutsuwada, Kawasaki, all of Japan

[73] Assignee: Canon Kabushiki Kaisha, Tokyo, Japan

[21] Appl. No.: 622,183

[22] Filed: Mar. 25, 1996

Related U.S. Application Data

[63] Continuation of Ser. No. 111,563, Aug. 24, 1993, abandoned.

[30] Foreign Application Priority Data

| | | | |
|---|---|---|---|
| Aug. 25, 1992 | [JP] | Japan | 4-248669 |
| Oct. 2, 1992 | [JP] | Japan | 4-289638 |
| Nov. 10, 1992 | [JP] | Japan | 4-323830 |

[51] Int. Cl.[6] ..... G03G 00/00

[52] U.S. Cl. ..... 399/45; 271/171; 271/265.02; 399/389

[58] Field of Search ..... 355/308, 309, 355/311; 271/171, 240, 258, 265; 399/370, 389, 392, 23, 45

[56] References Cited

U.S. PATENT DOCUMENTS

| | | | |
|---|---|---|---|
| 4,260,248 | 4/1981 | Murata et al. | 355/311 X |
| 4,294,535 | 10/1981 | Ariyama et al. | 271/171 X |
| 4,563,079 | 1/1986 | Inuzuka et al. | 355/311 X |
| 4,585,332 | 4/1986 | Shenoy | 355/311 X |
| 4,917,366 | 4/1990 | Murakami et al. | 270/53 |
| 5,110,106 | 5/1992 | Matsumura et al. | 271/171 X |
| 5,121,169 | 6/1992 | Kawabata | 355/311 |
| 5,159,387 | 10/1992 | Takahashi et al. | 355/311 X |
| 5,215,303 | 6/1993 | Yamada et al. | 271/240 |

FOREIGN PATENT DOCUMENTS

| | | | |
|---|---|---|---|
| 6--61425 | 4/1985 | Japan | 271/171 |
| 63-185730 | 8/1988 | Japan | 271/171 |

*Primary Examiner*—Fred L. Braun

*Attorney, Agent, or Firm*—Fitzpatrick, Cella, Harper & Scinto

[57] ABSTRACT

A copying apparatus provided with a manual sheet feeding device, including an image formation control unit for controlling an image forming operation, a manual input device for designating the size of a copying sheet placed on the manual sheet feeding device, a memory for memorizing the sheet size designated by the manual input device, and a display for displaying the sheet size memorized by the memory. The image formation control unit controls the image forming operation in accordance with the size designated by the manual input device.

24 Claims, 24 Drawing Sheets

FIG. 6

| | NAME | SIZE | JAPAN | NORTH AMERICA | EUR. /GERMANY FR. /U. K. | CENTRAL AMERICA | GENERAL |
|---|---|---|---|---|---|---|---|
| 1 | STMT-R | 139.5 × 216 | | ○ | | | ○ |
| 2 | A5R | 148.5 × 210 | ○ | ○ | ○ | ○ | ○ |
| 3 | B5R | 182 × 257 | ○ | | | | ○ |
| 4 | A4R | 210 × 297 | ○ | ○ | ○ | ○ | ○ |
| | A5 | 210 × 148.5 | ○ | ○ | ○ | ○ | ○ |
| 5 | LEGAR | 216 × 356 | | ○ | | | ○ |
| | LTR-R | 216 × 356 | | ○ | | | ○ |
| | STMT | 216 × 139.5 | | ○ | | | ○ |
| 6 | B5 | 257 × 182 | ○ | | | | ○ |
| | B4 | 257 × 364 | ○ | | | | ○ |
| 7 | LTR | 279 × 216 | | ○ | | | ○ |
| | 11" × 17" | 279 × 432 | | ○ | | | ○ |
| 8 | A4 | 297 × 210 | ○ | ○ | ○ | ○ | ○ |
| | A3 | 297 × 420 | ○ | ○ | ○ | ○ | ○ |

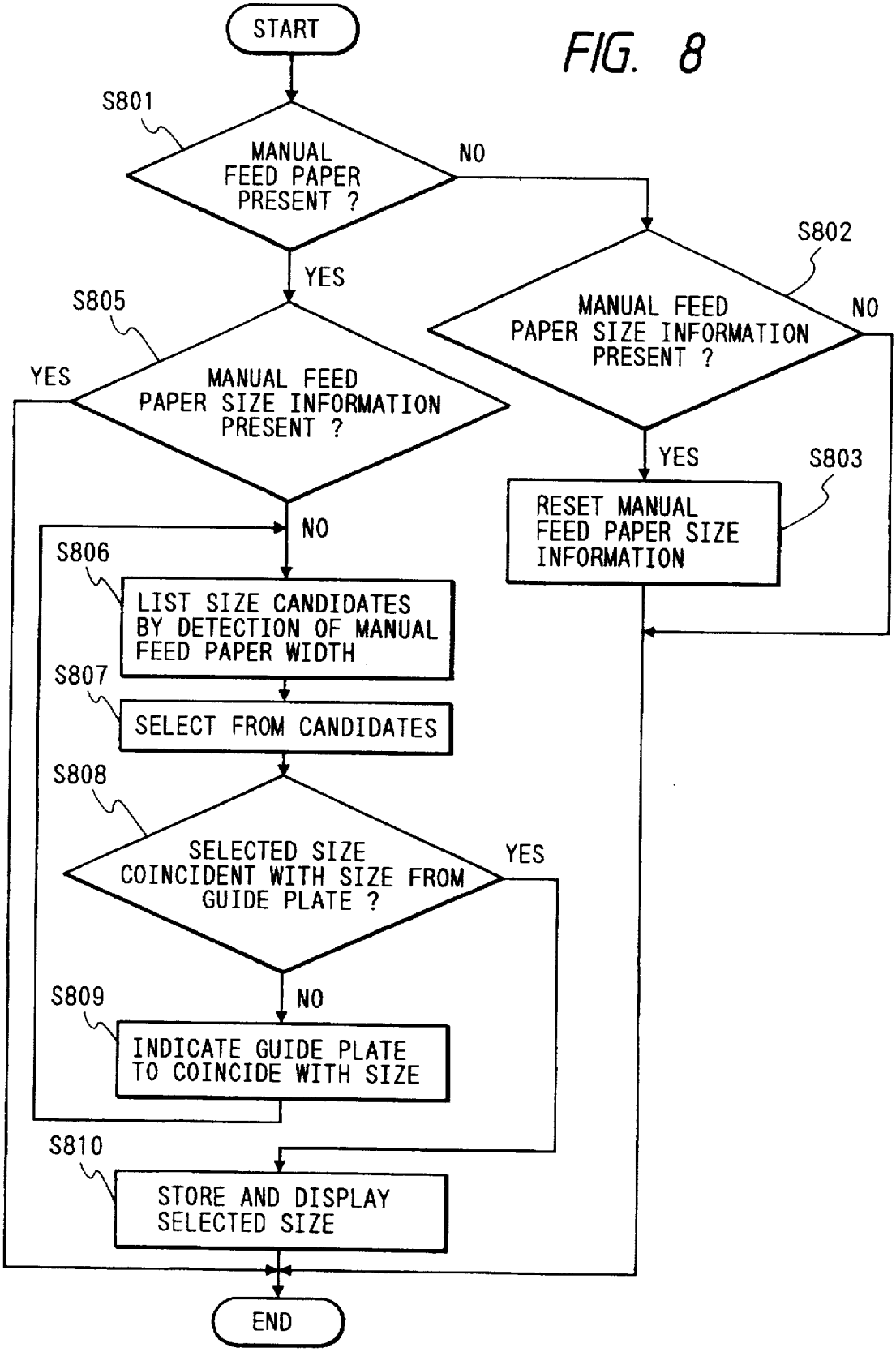
FIG. 8
START
S801
MANUAL FEED PAPER PRESENT ?
NO
YES
S802
MANUAL FEED PAPER SIZE INFORMATION PRESENT ?
NO
YES
S803
RESET MANUAL FEED PAPER SIZE INFORMATION
S805
MANUAL FEED PAPER SIZE INFORMATION PRESENT ?
YES
NO
S806
LIST SIZE CANDIDATES BY DETECTION OF MANUAL FEED PAPER WIDTH
S807
SELECT FROM CANDIDATES
S808
SELECTED SIZE COINCIDENT WITH SIZE FROM GUIDE PLATE ?
YES
NO
S809
INDICATE GUIDE PLATE TO COINCIDE WITH SIZE
S810
STORE AND DISPLAY SELECTED SIZE
END

FIG. 11

| | SW1 | SW2 | GROUPED PAPER |
|---|---|---|---|
| NO CASSETTE | 0 | 0 | |
| POSITION OF REAR END SET PLATE 14a | 1 | 0 | A3, 11×17, B4, A-OFI, A-LGL, B-OFI, LGL, A-FLSC |
| POSITION OF REAR END SET PLATE 14b | 0 | 1 | B5R, KOREA GOVERNMENT OFFICE FORM HORIZONTALLY, G-LTR HORIZONTALLY, A4 HORIZONTALLY, G-LGL, FOLIO, LTR HORIZONTALLY, FLSC, OFI, E-OFI, A-LTR HORIZONTALLY |
| POSITION OF REAR END SET PLATE 14c | 1 | 1 | STMT HORIZONTALLY, A5 HORIZONTALLY, A5, STMT, B5, A4, LTR, KOREA GOVERNMENT OFFICE FORM, G-LTR, A-LTR |

A-OFI: ARGENTINA OFFICIO
A-LGL: ARGENTINA LGL
A-LTR: ARGENTINA LTR
B-OFI: BOLIVIA OFFICIO
A-FLSC: AUSTRALIA FOOLSCAP
G-LTR: GOVERNMENT-LTR
G-LGL: GOVERNMENT-LEGAL
E-OFI: ECUADOR OFFICIO

FIG. 20
| A/D CONVERSION VALUE | PAPER SIZE GROUP |
|---|---|
| 85 ~ 91 | B5R |
| 125 ~ 130 | A4R |
| 133 ~ 139 | LTRR or LGL |
| 191 ~ 197 | B4 or B5 |
| 222 ~ 228 | LTR or 11×17 |
| 248 ~ 254 | A3 or A4 |
FIG. 21
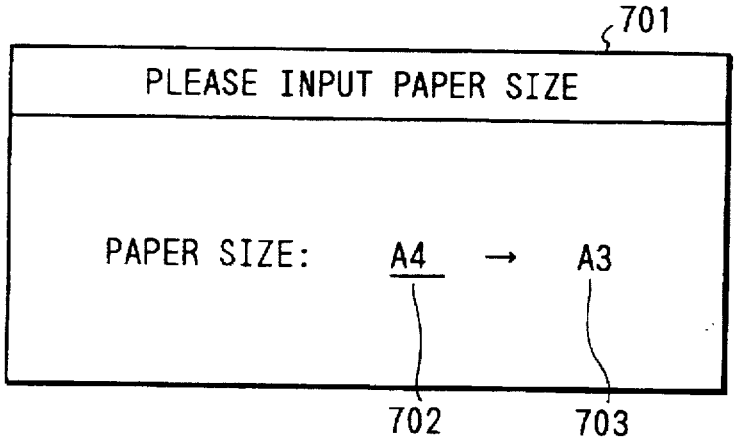
FIG. 22
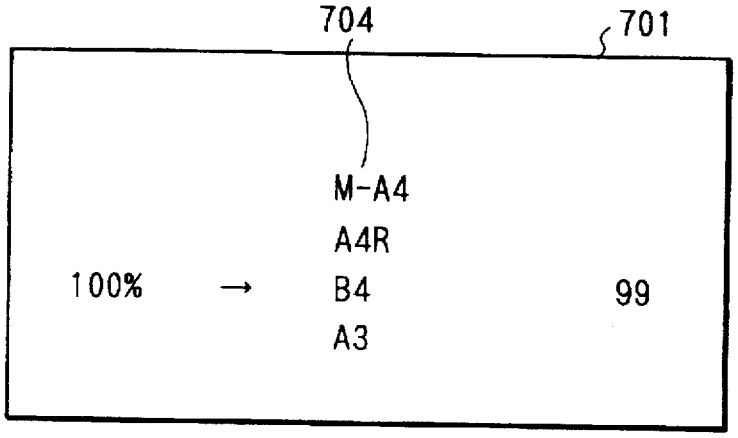

COPYING APPARATUS AND SHEET SIZE DETECTING DEVICE ADAPTED FOR USE THEREIN

This application is a continuation of application Ser. No. 08/111,563, filed Aug. 24, 1993, now abandoned.

BACKGROUND OF THE INVENTION

1. Field of the Invention

The present invention relates to a copying apparatus equipped with container means for containing recording media of a predetermined size, or manual sheet feeding means, and a sheet size detecting device adapted for use in such a copying apparatus.

2. Related Background Art

With the recent spread of office automation equipment, image processing apparatuses such as copying machines with highly advanced image processing functions have become popular. Such an image processing apparatus achieves image processing in combination with various functions such as the centering function for automatically moving the processed original image to the center of the recording sheet, the automatic image size varying function for automatically varying the magnification of the processed image, and the automatic sheet selecting function for detecting the size of the original image and automatically selecting the recording sheet matching the detected size. In such operations, it becomes necessary to detect the size of the image to be processed and the size of the recording sheet, prior to image processing.

Such sheet size detection in advance has conventionally been achieved by providing a cassette containing the recording sheets with a specific switch corresponding to the size of the sheet contained in the cassette and generating an electrical signal from the specific switch in response to the mounting of the cassette on the image processing apparatus.

The sheet sizes generally used in an image processing apparatus are widely diversified, including not only the postcard size, A5, A4, A3, B5, B4 sizes, with each size being positioned in a vertically or horizontally oblong position, but also special sizes used in certain countries. In addition, each user may independently use the specially sized sheet. In order to detect such diversified sheet sizes in the above-mentioned conventional size detecting device, there have to be prepared a number of cassettes respectively provided with specific switches corresponding to the sheet sizes, resulting not only in an increased dimension of the image processing apparatus itself and in a complex operation due to the frequent replacements of the cassettes, but also in an increased production cost.

Also, such apparatus is generally provided with various sheet feeding modes, and the recording sheet is supplied to the image forming station according to the sheet feeding mode selected by the operation unit, in order to record the original image on the recording sheet in various manners such as the single-side copying, two-side copying, single-side superposed copying and two-side superposed copying.

Also, such apparatus is often provided with a manual sheet feeding slot for enabling the user to manually insert a recording sheet and a feeding roller for detecting the sheet manually fed into the slot and transporting the manually fed sheet to a predetermined position in the apparatus.

Such apparatus effects a copying operation corresponding to the maximum feedable size for such manually fed sheet, because such sheet may be of an irregular size.

Since the manually fed sheets may be of an irregular size, the sheets inserted in the manual sheet feeding slot are not included as the candidate for selection in the automatic sheet size selection.

Also, in the two-side or superposed copying, the sheet feeding from the manual sheet feeding slot is inhibited because the manually fed sheets may be of an irregular size.

For this reason, the two-side or superposed copying can only be made with the sheets from a cassette, even if the manually fed sheets are of a regular size.

Also, in the automatic sheet size selecting mode, the sheets fed from the manual sheet feeding slot cannot be selected even if the sheets are of a regular size.

Also, in case the sheet sizes rendered feedable in the apparatus does not match the original size, for example, when B5- and A4-sized sheets are available in the apparatus while the original is of a B5R size, the automatic sheet size selection is not possible unless a pedestal or a cassette containing B5R-sized sheets is mounted in the apparatus. In such situation, even if the user sets the B5R-sized sheets in the manual sheet feeding slot, the automatic sheet size selecting function cannot be used as explained above. Consequently, the operator is compelled to effect a cumbersome sheet replacing operation.

Also, in case of sheet feeding from the manual sheet feeding slot, the automatic sheet selecting operation can be realized by the input of a sheet size by the operator, but an operation based merely on the size entered by the operator is unable to effectively cope with an eventually erroneous input of the operator. Furthermore, since sheets of irregular sizes are often supplied from the manual slot, the actual sheet size input operation is practically quite cumbersome, as the operator has to measure the horizontal and vertical sizes of such an irregular-sized sheet and to enter thus measured numbers.

On the other hand, in the manual sheet feeding slot, the sheet width may be detected by the defining plates guiding the lateral ends of the inserted sheets, but such method cannot specify the sheet size as it can only provide the width. Besides, exact sheet size cannot be obtained by this method, since the defining plates are not necessarily in close contact with the sheets.

SUMMARY OF THE INVENTION

An object of the present invention is to resolve the above-mentioned drawbacks.

Another object of the present invention is, in consideration of the prior art of the sheet size detecting device, to provide a sheet size detecting device of a simple structure capable of detecting a plurality of sheet sizes, without relying on plural cassettes corresponding to the number of sheet sizes.

The above-mentioned objects can be attained, according to the present invention, by a sheet size detecting device comprising sheet width setting means for setting an edge position in the direction of width of the sheet; sheet width detecting means for releasing a first electrical signal corresponding to the edge position in the direction of width set by the sheet width setting means; sheet length setting means for setting an edge position in the direction of length of the sheet; sheet length detecting means for releasing a second electrical signal corresponding to the edge position in the direction of length set by the sheet length setting means; and sheet size detecting means for detecting the size of said sheet based on the first and second electrical signals.

Also, for attaining the above-mentioned objects in the present invention, the first electrical signal released from the sheet width detecting means may be a continuously variable electrical signal defining the sheet width, and the second electrical signal released from the sheet length detecting means may be an electrical signal belonging to one of plural divided sheet length ranges respectively defining regular sizes.

In the above-explained configuration, the sheet width setting means sets the edge position of the sheet in the transversal direction thereof, and the sheet width detecting means releases the first electrical signal corresponding to the edge position of the sheet in the transversal direction thereof, set by the sheet width setting means. On the other hand, the sheet length setting means sets the edge position of the sheet in the longitudinal direction thereof, and the sheet length detecting means releases the second electrical signal corresponding to the edge position of the sheet in the direction of length thereof. Then, the sheet size detecting means detects the sheet size based on the first and second electrical signals.

Also, according to the present invention, the sheet width setting means sets the edge position of the sheet in the direction of width, and the sheet width detecting means releases the first continuous electrical signal corresponding to the edge position of the sheet in the direction of width thereof and designating the sheet width. On the other hand, the sheet length setting means sets the edge position of the sheet in the direction of length thereof, and the sheet length detecting means releases the second electrical signal corresponding to the edge position of the sheet in the direction of length, set by the sheet length setting means, and designating one of the regular sheet sizes corresponding to the plural divided sheet length ranges. Then, the sheet size detecting means detects the sheet size, based on the first and second electrical signals. In this configuration, if plural regular-sized sheets are contained in one of the plural sheet length ranges, the final detection is made according to an order of priority given to such regular sizes.

Still another object of the present invention is to provide a copying apparatus allowing to designate the size of manually fed sheet, thereby being capable of executing the copying sequence in the automatic sheet selecting mode, the multiple copying mode or the two-side copying mode even in case of manual sheet feeding.

The copying apparatus of the present invention comprises plural container means for containing recording sheets of predetermined sizes; manual sheet feeding means for feeding manually fed recording sheets; mode setting means for selecting one of the automatic sheet selecting mode, the multiple copying mode and the two-side copying mode; width detecting means for detecting the width of the recording sheet fed from the manual sheet feeding means; sheet detecting means for detecting the presence or absence of the recording sheet fed from the manual sheet feeding means; manual feed sheet size display means for displaying the candidates of manually feedable sheet sizes on a display unit, based on the width information detected by the width detecting means; and selection means for selecting one of the sheet size candidates displayed on the display unit by the manual feed sheet size display means; wherein the sheet size selected by the selection means is designated as the manual feed sheet size in the mode setting by the mode setting means.

Also, there may be provided memory means for memorizing the designated manual feed sheet size.

Furthermore, there may be additionally provided size memory means for memorizing the size candidate data of the manually feedable recording sheet, given according to the width information detected by the width detecting means, and display control means for successively reading thus memorized size candidate data, according to a predetermined order of priority, for display on the display unit.

Furthermore, the display control means may be so constructed as to successively read the size candidate data, memorized in the size memory means, for display on the display unit, based on an order of priority according to the width information detected by the width detecting means.

Furthermore, the display control means may be so constructed as to read the size candidate data, memorized in the size memory means, and to display the data in the order of reading.

Furthermore, there may be additionally provided designation means for disabling or enabling the preferential display control of the size candidate data by the display control means, which displays the size candidate data according to the enabling or disabling instruction by the designation means.

In the present invention, the detection of the width of the manually fed sheets by the width detecting means allows to recognize the size candidates of the manually feedable sheets, and the selection of one of thus recognized size candidates by the selection means allows recognition of the size of the recording sheet fed from the manual sheet feeding means. Thus, in any of the automatic sheet selecting mode, the multiple copying mode and the two-side copying mode selected by the mode setting means, the copying sequence with the recording sheet fed from the manual sheet feeding means is permitted. In this manner the copying sequence of the automatic sheet selection, the multiple copying or the two-side copying can be executed on the manually fed sheets.

Also, since the manually fed sheet size can be memorized in the memory means, it is rendered possible to continuously designate the manual sheet feeding with the thus memorized sheet size.

Also, since the size candidate data memorized in the size memory means can be read and displayed in succession by the display control means according to the predetermined order of priority, it is rendered possible to display a desired size candidate from the size candidates corresponding to the detected sheet width.

Also, since the size candidate data memorized in the size memory means can be read and displayed by the display control means according to the order of priority based on the width information detected by the width detecting means, it is rendered possible to display a desired manual feed size as the highest priority candidate, from the size candidates corresponding to the detected sheet width.

Also, since the size candidate data memorized in the memory means can be read and displayed by the display control means as the highest priority candidates, it is rendered possible to display a desired manual feed size selected before, as the highest priority candidate.

Also, since the size candidate data can be displayed by said display control means according to the disabling or enabling instruction of the designation means, the preferential display may be selectively executed.

Still another object of the present invention is to provide a copying apparatus enabling sheet feeding also from the manual sheet feeding unit in the two-side or multiple copying and in the automatic sheet selection mode, and capable of specifying the sheet size and selecting the sheet automatically with simple operations, thereby ensuring secure copying.

The apparatus of the present invention is featured by sheet width defining means for defining the sheet width; sheet width detecting means for detecting the movement of the sheet width defining means as a voltage; first memory means for memorizing the width of sheet of a first predetermined size; second memory means for memorizing the width of sheet of a second predetermined size different from the first predetermined size; calculation means for calculating the sheet size based on the sheet sizes memories in the memory means and the value detected by the detection means; and sheet size selection means for displaying selectable sheet sizes specified from the result of calculation by the calculation means, thereby causing the operator to select a sheet size.

BRIEF DESCRIPTION OF THE DRAWINGS

FIG. 6 is a schematic table for detecting the sheet size from the sheet width in the first embodiment;

FIG. 8 is a flow chart showing the function of a second embodiment of the present invention;

FIG. 11 is a table showing the relationship between a second electrical signal of the sub-scan length detecting unit in the third embodiment and grouped regular-sized sheets;

FIG. 20 is a schematic view showing a conversion table for calculating sheet size groups in the sixth embodiment;

FIG. 21 is a schematic view showing a displayed image frame in the sixth embodiment;

FIG. 22 is a schematic view showing another displayed image frame in the sixth embodiment;

DETAILED DESCRIPTION OF THE PREFERRED EMBODIMENTS

[First embodiment]

Figure 1:
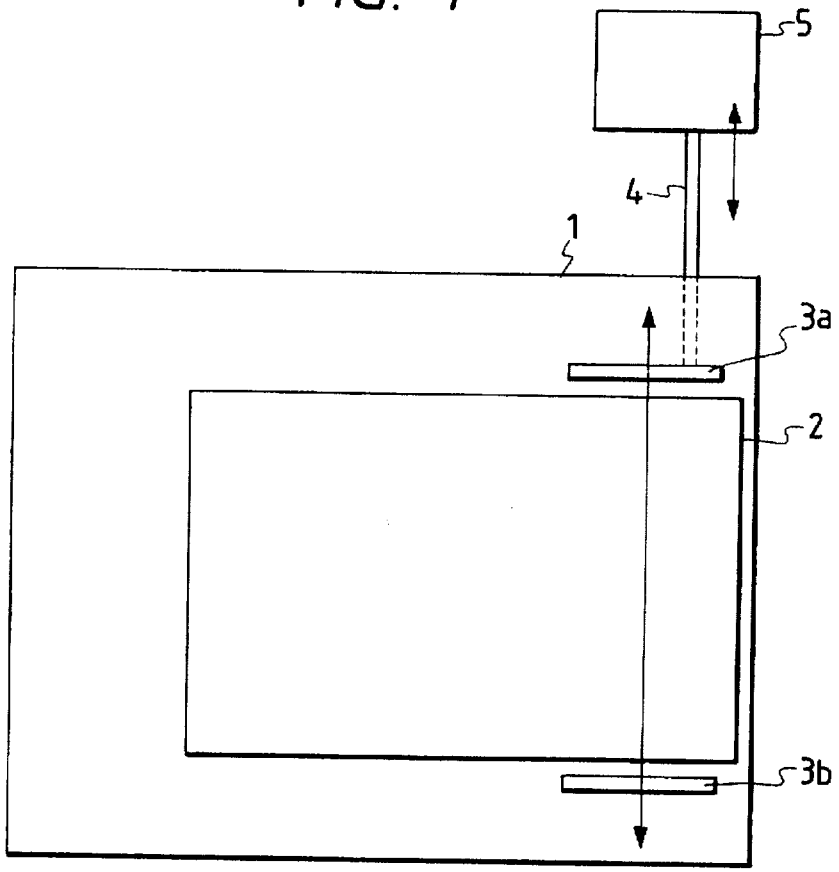
FIG. 1 is a plan view of a manual sheet feeding unit showing a first embodiment of the sheet size detecting device of the present invention.

FIG. 1 is a plan view of a manual sheet feeding unit, showing a first embodiment of the sheet size detecting device of the present invention.

A cassette 1, constituting the manual sheet feeding unit in which the sheet size detecting device is provided, is provided with lateral defining plates 3*a*, 3*b*, a main scan detecting, guide 4, and a main scan length detecting unit 5.

Sheets 2, set in the cassette 1, are defined in lateral position thereof by the lateral defining plates 3*a*, 3*b*.

Figure 2:
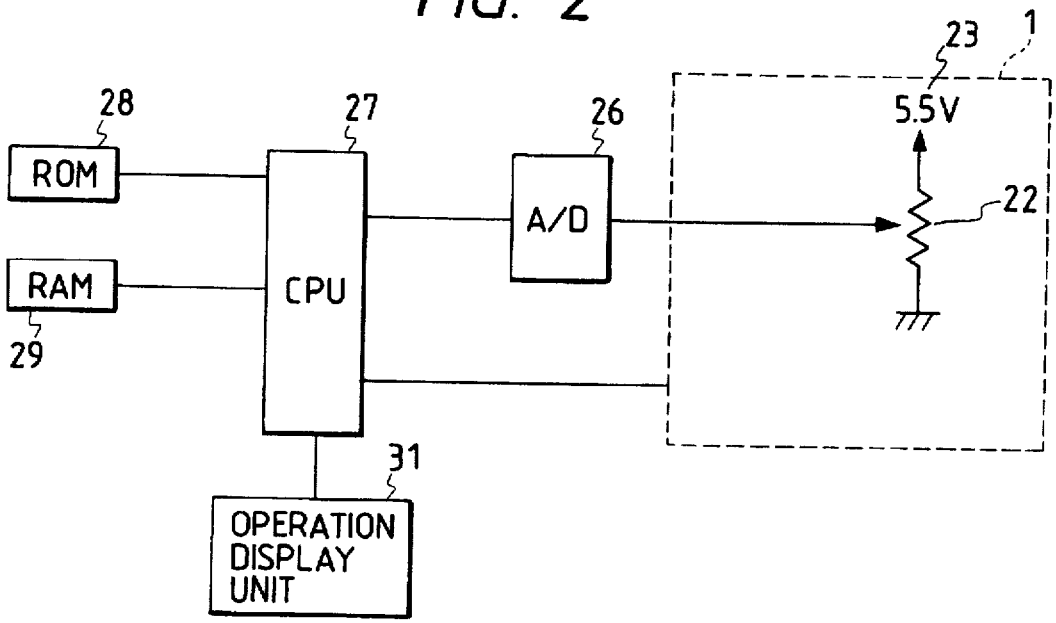
FIG. 2 is a block diagram of a control circuit in the first embodiment.

FIG. 2 is a block diagram of a control circuit in this embodiment.

A variable resistor 22 is provided in the main scan length detecting unit 5 of the cassette shown in FIG. 1, and serves to detect the main scan length of the sheet 2 set in the cassette 1, based on the positions of the lateral defining plates 3*a*, 3*b*. A voltage 23 of 5.5 V is applied across the variable resistor 22.

An A/D converter 26, of 8 bits in the present embodiment, serves to convert the analog voltage from the variable resistor 22 into a digital value.

A CPU 27, controlling not only the sheet size detecting device but also the entire system of the copying apparatus, is connected with the A/D converter 26, a ROM 28, a RAM 29 and an operation/display unit 31.

The RAM 29 is provided with a power source for retaining the data after the main power supply is turned off, and is also used for data back-up. The operation/display unit 31 is used for entering instructions for adjustments of the apparatus and for control of the main body, and for displaying the operation status.

Figure 3:
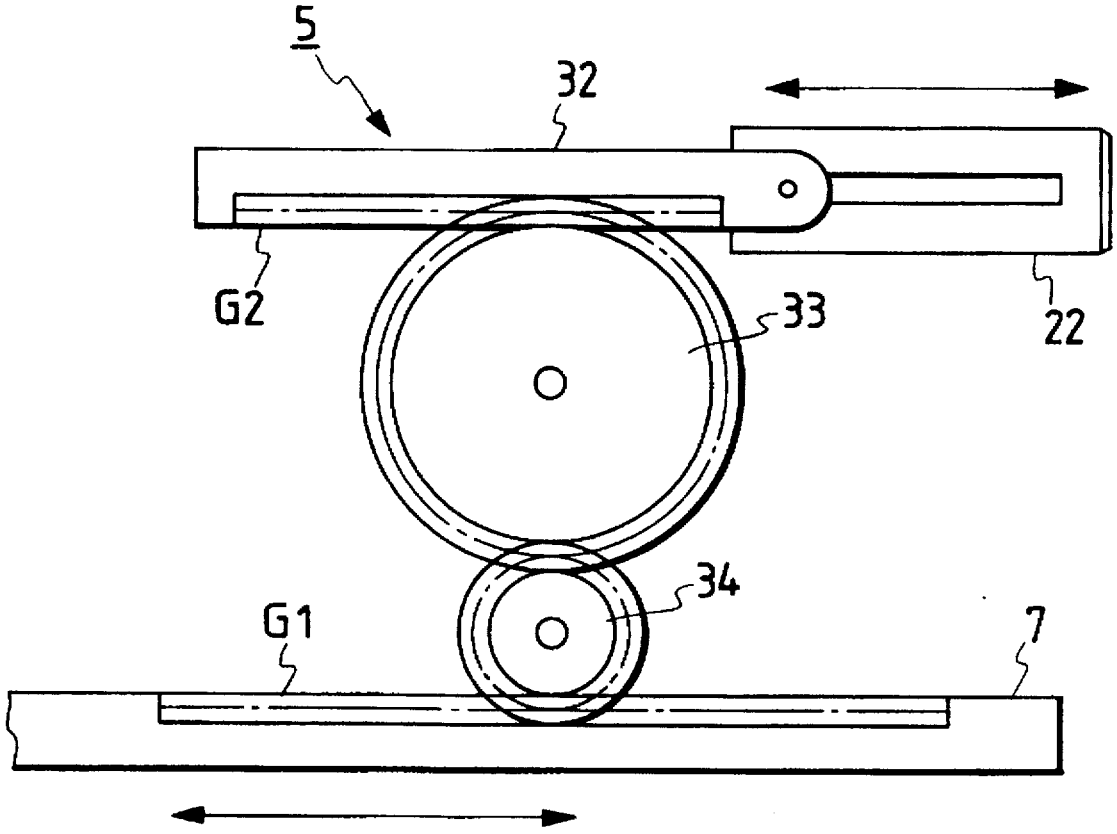
FIG. 3 is an elevation view showing the configuration of a main scan length detecting unit in the first embodiment.

FIG. 3 is a schematic view of the principal part of the main scan length detecting unit 5. A main scan detecting guide 7, of which an end is connected to the aforementioned lateral defining plates 3a, 3b, is provided at the other end with engaging teeth G1 meshing with a reducing gear 34 which in turn meshes with a reducing gear 33. A guide 32, of which engaging teeth G2 mesh with the reducing gear 33, is connected at an end to the slider of the variable resistor 22. By movements indicated by an arrow, the variable registor 22 generates a voltage corresponding to the position of the slider, and the variable resistor is so selected as to have satisfactory linearity of the generated voltage in relation to the sliding distance. Also, the reducing gears 33, 34 are so selected that the moving range of the main scan detecting guide 7 caused by the movement of the lateral defining plates 3a, 3b is about 90% of the movable range of the variable resistor 22. In this manner, when the lateral defining plates 3a, 3b set the edge positions of the sheet 2 in the transversal direction thereof, a first electrical signal corresponding to the edge positions is released from the variable resistor 22.

In the following there will be explained the sheet size detecting operation in the first embodiment explained above. At first explained is the sheet width selecting operation.

Figure 4:
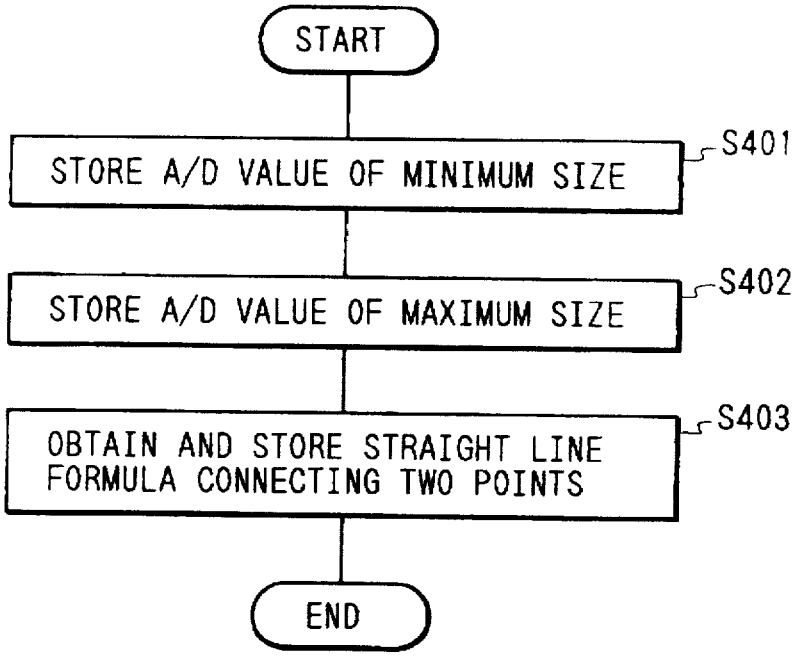
FIG. 4 is a flow chart of a main scan length adjusting sequence in the sheet size detecting device of the first embodiment.

FIG. 4 is a flow chart showing an in-advance data input sequence prior to the sheet width detecting operation in the first embodiment. At first, a sheet 2 of a minimum settable size (A5 size: width 148.5 mm) is placed on the cassette 1 as shown in FIG. 1, and the lateral defining plates 3a, 3b are so positioned as to contact the lateral edges of the sheet 2, thereby setting the edge positions of the sheet 2 in the transversal direction. In response to the position setting by the lateral defining plates 3a, 3b, the main scan detecting guide 7 is moved, whereby the main scan detecting unit 5 enters a detection signal for the minimum size into the CPU 207 through the A/D converter 206. In a step S401, the CPU 207 stores the detection signal of the minimum size in the RAM 209. Then, a sheet 2 of a maximum settable size (A4 size: width 297 mm) is placed on the cassette 1, and the lateral defining plates 3a, 3b are so positioned as to contact the lateral edges of the sheet 2, thereby setting the edge positions of the sheet 2 in the transversal direction. In response to the position setting by the lateral defining plates 3a, 3b, the main scan detecting guide 7 is moved, whereby the main scan detecting unit 5 enters a detection signal for the maximum size into the CPU 207 through the A/D converter 206. In a step S402, the CPU 207 stores the detection signal of the maximum size in the RAM 209.

Figure 5:
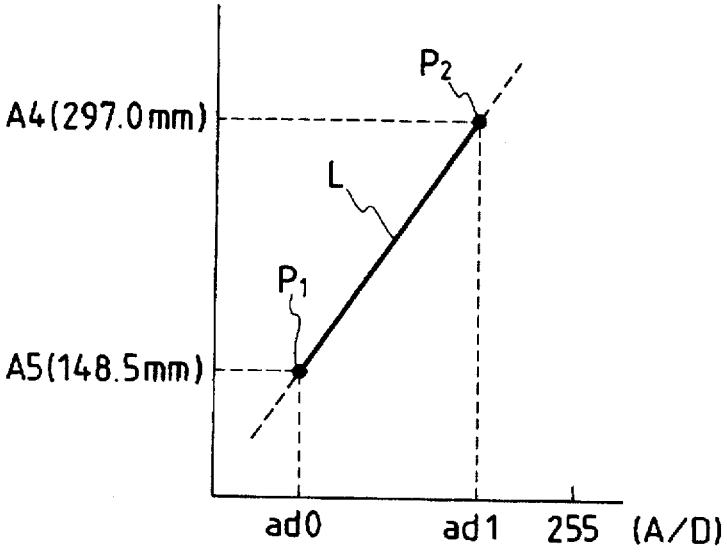
FIG. 5 is a schematic view for explaining the principle of determining a linear equation for calculating an arbitrary sheet width from the minimum and maximum values of the sheet width in the first embodiment.

As shown in FIG. 5, a straight line L passing through two points P1, P2 determined in the steps S401, S402 is given by the equation (1):

$$L=a\times A/D\ \text{value}+B \tag{1}$$

Thus, a step S403 calculates the constants a, b of the equation (1) from the equations (2) and (3) based on the points P1, P2 shown in FIG. 5, and stores the constants in the RAM 209:

$$a=(A4-A5)/(ad1-ad0) \tag{2}$$

$$b=(A4\times ad0-A5\times ad1)/(ad1-ad0) \tag{3}$$

The width, or the main scanning size, of a sheet 2 set in the cassette 1 can be detected by substituting the constants a, b thus calculated and stored in the RAM 209 and the detected A/D value obtained from the main scan detecting unit 5 when the lateral edge positions of the sheet 2 are set by the lateral defining plates 3a, 3b, into the equation (1).

Figure 7:
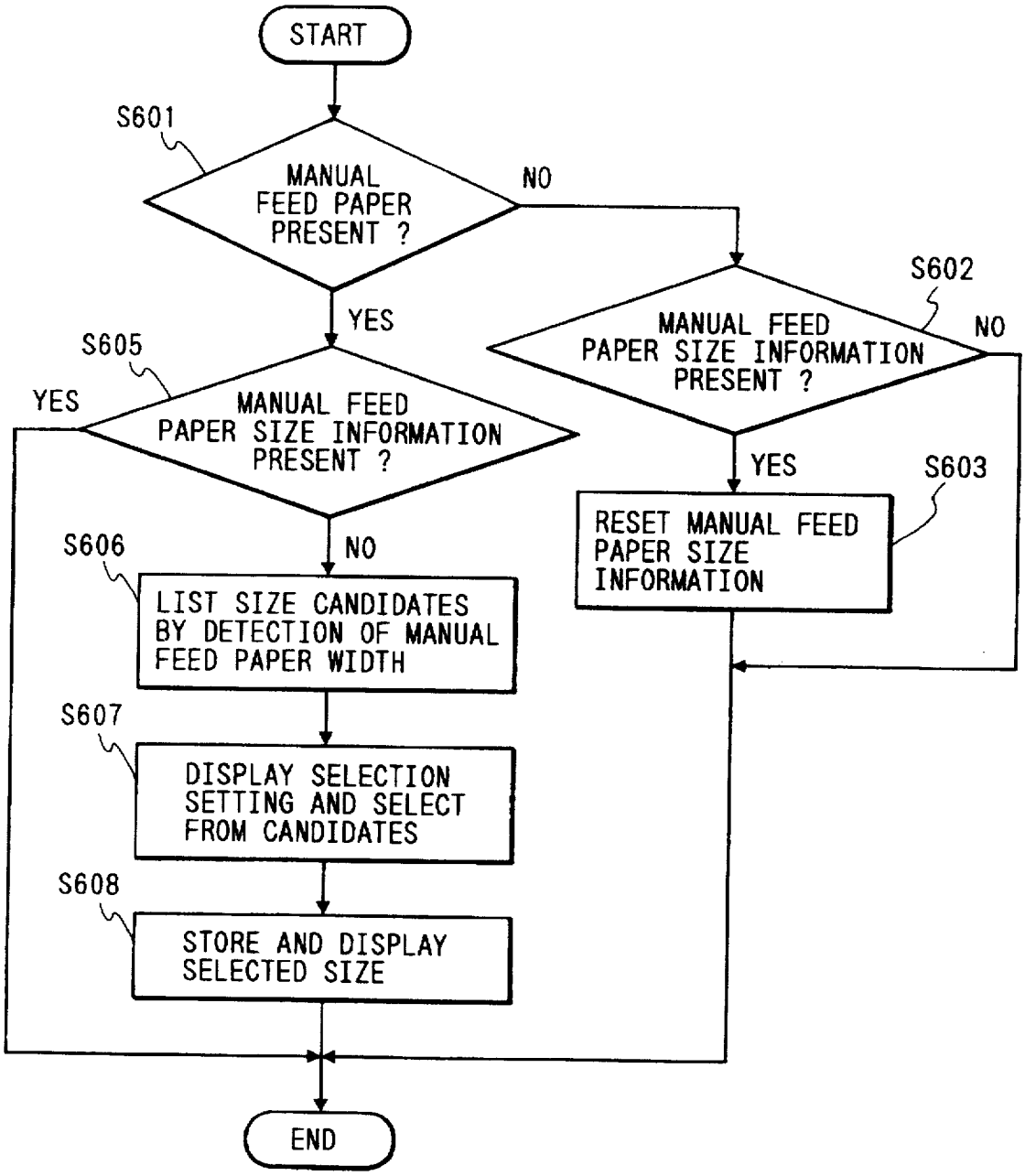
FIG. 7 is a flow chart of the sheet size setting sequence in the first embodiment.

FIG. 6 is a table for detecting the sheet size from the sheet width, and FIG. 7 is a flow chart for setting the sheet size.

A step S601 detects the presence or absence of sheet setting by a sheet sensor (not shown), then, if the sheet is not detected, a step S602 discriminates the presence or absence of size information for the manually fed sheet, and the sequence is terminated if the size information is absent, but, if the size information is present, a step S603 resets (initializes) the size information.

On the other hand, if the step S601 identifies the presence of a sheet, a step S605 discriminates the presence or absence of manual feed information, and, if the information is present, the sequence is terminated.

If the step S605 identifies the absence of manual feed information, a step S606 prepares a list of the candidate sheet sizes, based on the sheet width calculated as explained above. In this case, sizes not exceeding the detected size are listed as candidates, because the operator might have simply placed the sheet on the manual sheet feeding unit and have not adjusted the defining plates. Subsequently, the sequence proceeds to a step S607.

For example, if the detected width corresponds to the width of A4R size, there are listed five candidate sheet sizes, i.e. A5, A4R, B5R, A5R and no designation.

The step S607 causes the user to select the size of the manually fed sheet, and a step S608 displays the designated sheet size.

This setting sequence enables the sheet feeding from the manual sheet feeding unit, except for the case of no sheet size designation, in the copying modes of automatic sheet selection, two-side and multiple copying operation utilizing the intermediate tray.

In the first embodiment explained above, when a sheet size is selected from plural candidates, the sheet size is memorized. However, it is also possible to compare the width of the selected sheet size with the information obtained from the lateral defining plates, and to memorize selected information if both mutually coincide, but to select the case of no size designation without memorizing the selected information if both do not mutually coincide.

[Second embodiment]

In a second embodiment of the present invention explained in the following, the configurations of the sheet size detecting device and of the control circuit are the same as those in the first embodiment.

In the first embodiment explained above, when a sheet size is selected from plural candidates, the information on thus selected sheet size is memorized. In this second embodiment, when a sheet size is selected, the width of the selected size is compared with the information obtained from the lateral defining plates, and the information on the selected size is memorized if both mutually coincide, but, if both do not mutually coincide, an instruction is given to the operator to adjust the lateral defining plates to the sheet. After the defining plates are adjusted, the candidate sheet sizes are listed again, and a sheet size is selected therefrom.

FIG. 8 is a flow chart of the above-explained sequence, wherein the steps S801 to S807 are the same as those S601 to S607 in FIG. 7, and a step S810 is the same as the step S608.

A step S808 compares the sheet size selected in the step S807 with the information obtained from the lateral defining plates, and the sequence proceeds to a step S809 if both are mutually different.

The step S809 provides an instruction to adjust the lateral defining plates to match the sheet width. Then, the step S808 again compares the sheet size with the information from the defining plates, and, if both mutually coincide, the sequence proceeds to the step S810.

In the first and second embodiments, as explained in the foregoing, the input of the manually fed size by the operator enables the sheet feeding from the manual sheet feeding unit in the two-side or multiple copying utilizing the intermediate tray and in the automatic sheet selecting mode.

[Third embodiment]

Figure 10:
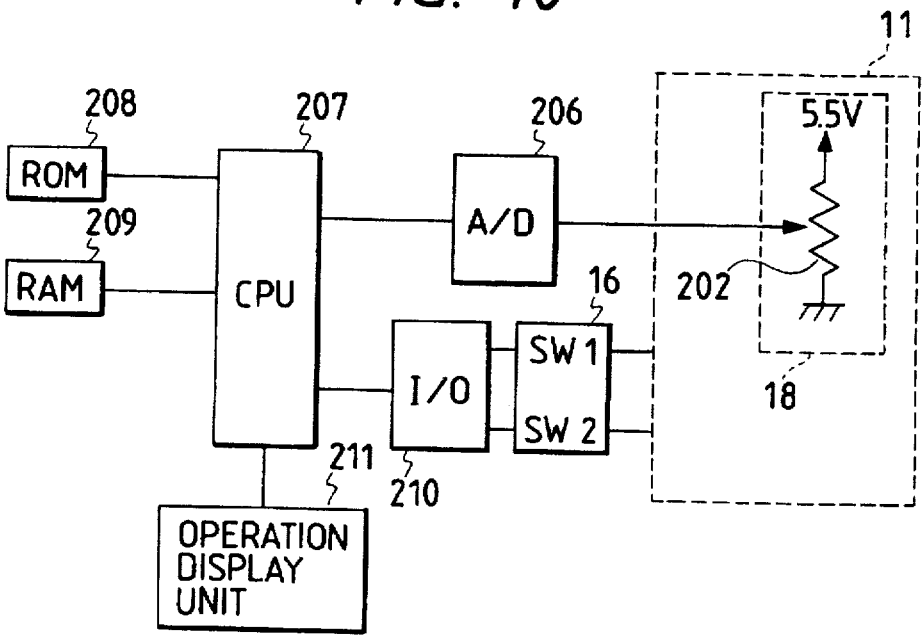
FIG. 10 is a block diagram showing the schematic configuration of the third embodiment.

FIG. 10 is a block diagram of the entire configuration of a third embodiment, wherein a cassette 11 containing sheets is provided with a main scan detecting unit 18, which contains a variable resistor 202 grounded at an end and receiving a bias voltage of 5.5 V at the other end, and releases a first electrical signal corresponding to the edge position of the sheet in the transversal direction. The main scan detecting unit 18 is connected, through an 8-bit A/D converter 206 for converting the analog signal from the variable resistor 202 into a digital signal, to a CPU 207 for controlling the entire system. The CPU 207 is also connected to a ROM 208 storing control programs, a RAM 209 for writing and reading various data in the control operation, and an operation/display unit 211 for entering instructions for adjustments or controls of the apparatus and displaying the operation status. The RAM 209 is provided with a back-up power source in order to retain the data when the main power supply is cut off. The CPU 207 is further connected, through an I/O circuit 210, to a sub-scan length detecting unit 16 provided with switches SW1, SW2 and connected to the cassette 11.

Figure 9:
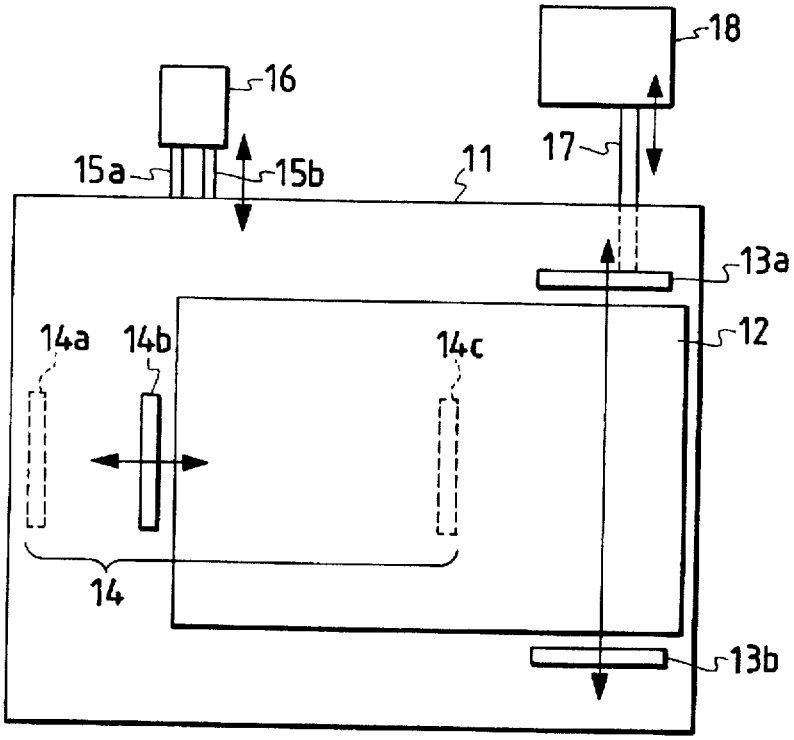
FIG. 9 is a schematic view of the principal part of a third embodiment of the present invention.

FIG. 9 is a schematic view of the principal part of the third embodiment. A sheet 12 is placed on the cassette 11, and lateral defining plates 13*a*, 13*b* are positional corresponding to the lateral edges of the sheet 12 in the transversal direction thereof. The defining plates 13*a*, 13*b* are connected, through a main scan detecting guide 17, to the main scan detecting unit 18. Also, a rear end defining plate 14 is positioned corresponding to an edge of the sheet 12 in the longitudinal direction thereof, for defining the longitudinal position of the sheet 12. The rear end defining plate 14 is connected, through sub-scan detecting guides 15*a*, 15*b*, to a sub-scan detecting unit 16.

The detection of the size of the sheet in the main scanning direction, by the main scan detecting unit 18 is executed in the same manner as in the first embodiment, and will not, therefore, be explained further.

The sub-scan detecting unit 16 classifies the length of the sheet 12 into three regions, depending whether the rear end defining plate 14 is in a position 14*a* (corresponding to a sub-scan length exceeding 335 mm), a position 14*b* (sub-scan length of 232 to 335 mm) or a position 14*c* (sub-scan length not more than 232 mm), and the sub-scan detecting guides 15*a*, 15*b* are made to assume different detecting states respectively in said regions.

In the following, there will be explained the detecting operation for the sub-scan size of the sheet.

As explained in the foregoing, the sub-scan detecting unit 16 divides the sheet length into three regions and is so constructed that the sub-scan detecting guides 15*a*, 15*b* assume different detecting states respectively in the divided regions, whereby the switches SW1, SW2 assume respectively different switching states to generate a second electrical signal. A chart shown in FIG. 11 indicates these states, wherein the on/off states of the switches SW1, SW2 vary depending on the position of the rear end defining plate 14 at 14*a*, 14*b* or 14*c*, and the sheets are grouped according to the states. More specifically, a switch state in which SW1, SW2 are (0, 0) indicates the absence of the cassette. A switch state in which SW1, SW2 are (1, 0) corresponds to a cassette for a sheet of a sub-scan length exceeding 335 mm. A switch state in which SW1, SW2 are (0, 1) corresponds to a cassette for a sheet 12 with a sub-scan length from 232 to 335 mm. A switch state in which SW1, SW2 are (1, 1) corresponds to a cassette for the sheet 12 with a sub-scan length not more than 232 mm.

The size of the sheet 12 is detected from the main scan size and the sub-scan size thus detected, but there may be detected plural regular sheet sizes because the detected sub-scan length involves a certain range. For example, the foolscap size (216×317 mm), the officio size (216×317 mm) and the E-OFI size (220×329 mm) may be detected at the same time. In such case, according to the third embodiment, there is recognized a sheet size of a high priority, according to an order of priority given in advance to these regular sheet sizes.

Figure 12:
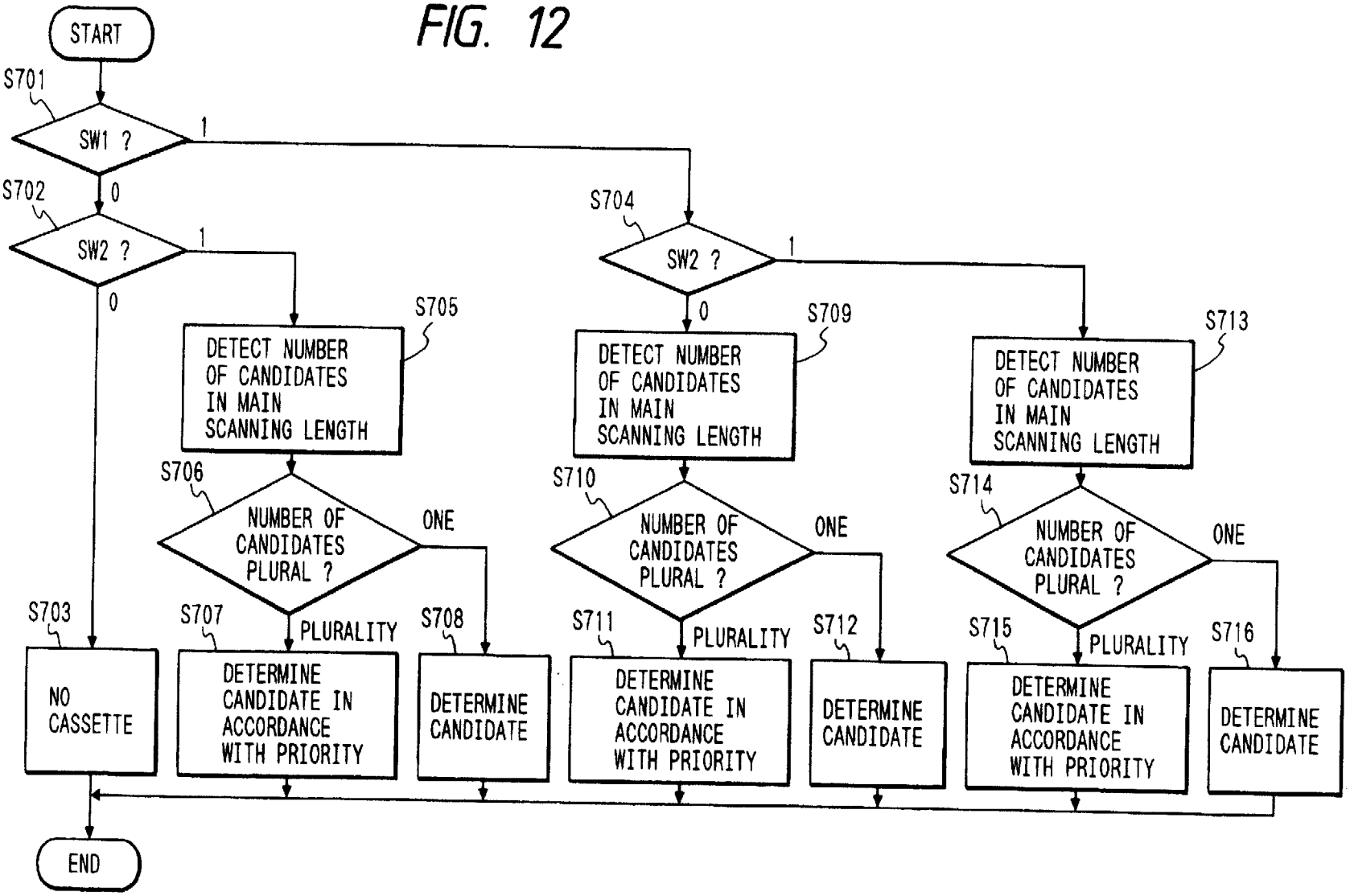
FIG. 12 is a flow chart showing the function of the third embodiment.

Now, reference is made to FIG. 12 for explaining the sheet size detecting operation in the third embodiment. At first, a step S701 discriminates the state of the switch SW1, and, if it is "1", a step S704 discriminates the state of the switch SW2. On the other hand, if the switch SW1 is "0", a step S702 discriminates the state of the switch SW2, and, if it is "0", a step S703 identifies a state without the cassette and stores a status code indicating the absence of the cassette in a cassette status memory area in the RAM 209.

On the other hand, if the step S702 identifies the state of the switch SW2 as "1", a step S705 counts the number of candidates of the sheet size within a sub-scan length region of 232 to 335 mm, and a step S706 discriminates the number of the candidates in order to limit the candidates by the main scan length. If there is only one candidate, a step S708 adopts the candidate and stores the cassette code of thus determined candidate in the cassette status memory area of the RAM 209. If the step S706 identifies the presence of plural candidates, a step S707 determines a candidate according to the order of priority in the plural candidates and stores the cassette code of thus determined candidate in the cassette status memory area of the RAM 209.

On the other hand, if the step S701 identifies the state of the switch SW1 as "1", a step S704 discriminates the state of the switch SW2. If it is identifies as "0", a step S709 counts the number of candidates of the sheet size for a sub-scan length region exceeding 335 mm, and a step S710 discriminates the number of the candidates in order to limit the candidates by the main scan length. If there is only one candidate, a step S712 adopts the candidate and stores the cassette code of thus determined candidate in the cassette status memory area of the RAM 209. If the step S710 identifies the presence of plural candidates, a step S711 determines a candidate according to the order of priority in the plural candidates and stores the cassette code of thus determined candidate in the cassette status memory area of the RAM 209.

On the other hand, if the step S704 identifies the state of the switch SW2 as "1", a step S713 counts the number of candidates of the sheet size for a sub scan length region not more than 232 mm, and a step S714 discriminates the number of the candidates in order to limit the candidates by the main scan length. If there is only one candidate, a step S716 adopts the candidate and stores the cassette code of thus determined candidate in the cassette status memory area of the RAM 209. If the step S714 identifies the presence of plural candidates, a step S715 adopts the candidate and stores the cassette code of thus determined candidate in the cassette status memory area of the RAM 209. If the step S714 identifies the presence of plural candidates, a step S715 determines a candidate according to the order of priority in the plural candidates and stores the cassette code of thus determined candidate in the cassette status memory area of the RAM 209.

In this third embodiment, as explained in the foregoing, the sheet size is detected from the edge positions of the sheet, defined by the lateral defining plates 3a, 3b and the rear end defining plate 14, and, if the final selection of a regular-sized sheet is requested among plural candidates, such selection is properly executed according to a predetermined order of priority.

[Fourth embodiment]

In a fourth embodiment to be explained in the following, setting means for setting the order of priority to the plural candidate sheet sizes is connected to the CPU 207 and the setting state can be displayed on the operation/display unit 211. The remaining parts of the fourth embodiment are identical with those of the foregoing third embodiment.

Figure 13:
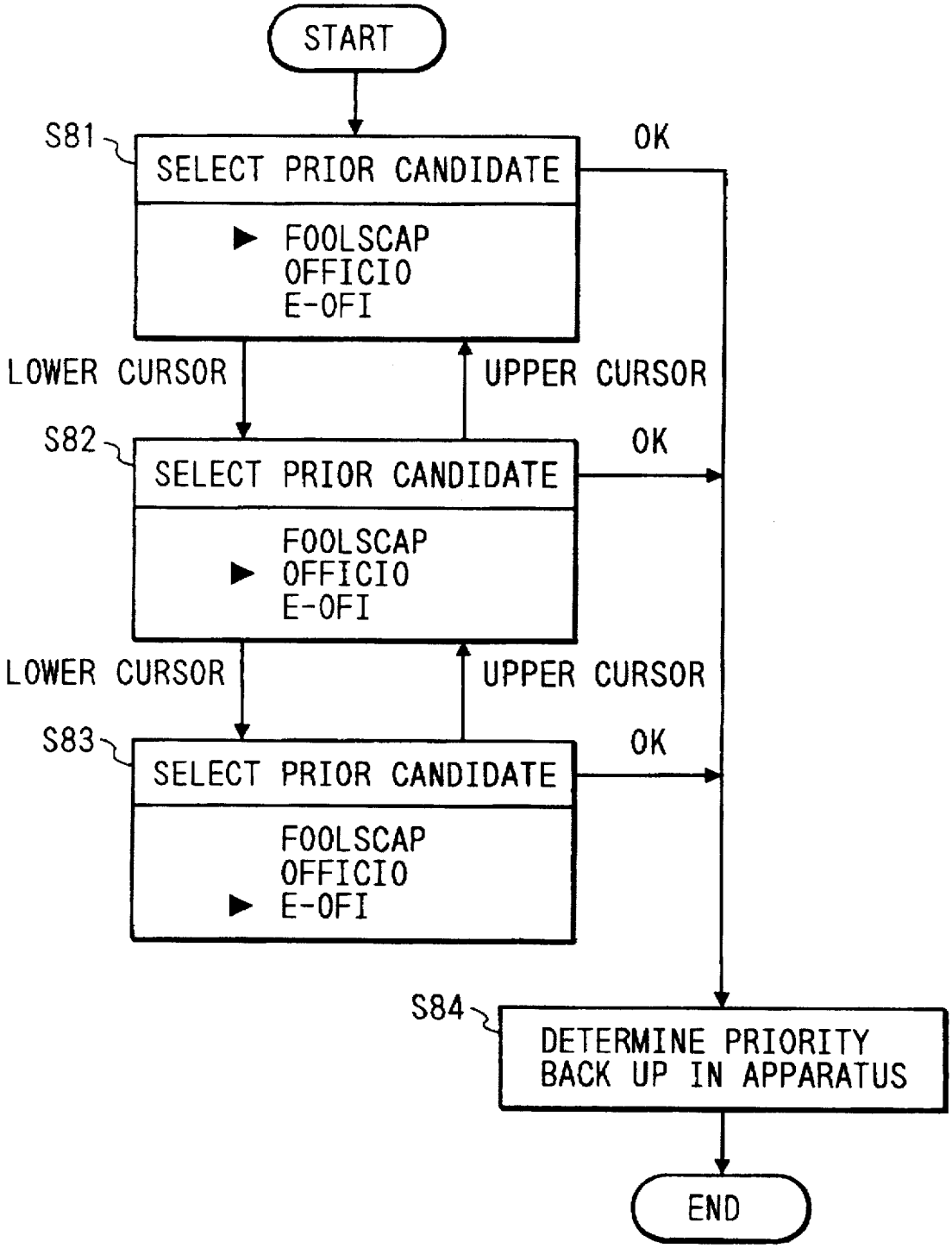
FIG. 13 is a flow chart showing the function of a fourth embodiment of the present invention.

FIG. 13 is a flow chart showing the sequence of setting the order of priority in the fourth embodiment. When there exist plural candidate regular sizes, a step S81 displays the candidates on the operation/display unit 211 as shown in FIG. 13. In response, the operator sets the order of priority of detection for the regular sizes FOOLSCAP, OFFICIO and E-OFI by manipulating the keyboard. For selecting the FOOLSCAP size, the operator moves the cursor to a position corresponding to the FOOLSCAP as shown in the step S81 and depresses the execution key, whereby a step S84 sets the order of priority and the cassette code of thus determined candidate is stored in the cassette status memory area of the RAM 209. For selecting the OFFICIO size, or the E-OFI size, the operator moves the cursor to the corresponding position as shown in the step S82 or S83 and depresses the execution key for proceeding to the step S84. In this case, the desired regular-sized sheet may also be selected by means of DIP switches.

In the fourth embodiment, as explained in the foregoing, the sheet size is detected according to the edge positions of the sheet defined by the lateral defining plates 13a, 13b and the rear end defining plate 14, and, if the selection of a regular-sized sheet is required from plural candidates, the operator can set an optimum order of priority according to the state of use of the image processing apparatus, so that the sheet size detection is executed, matching the state of use of the apparatus by the user. Other functions and effects of the fourth embodiment are same as those of the third embodiment already explained.

[Fifth embodiment]

In a fifth embodiment to be explained in the following, the order of priority is determined in advance, in consideration of the destination of the apparatus. As already shown in FIG. 11, certain countries such as Argentina, Australia or Ecuador adopt special regular sizes, so that a special order of priority is apparently required in certain destinations of the apparatus. Other configurations of the fifth embodiment are the same as those of the third embodiment already explained.

Figure 14:
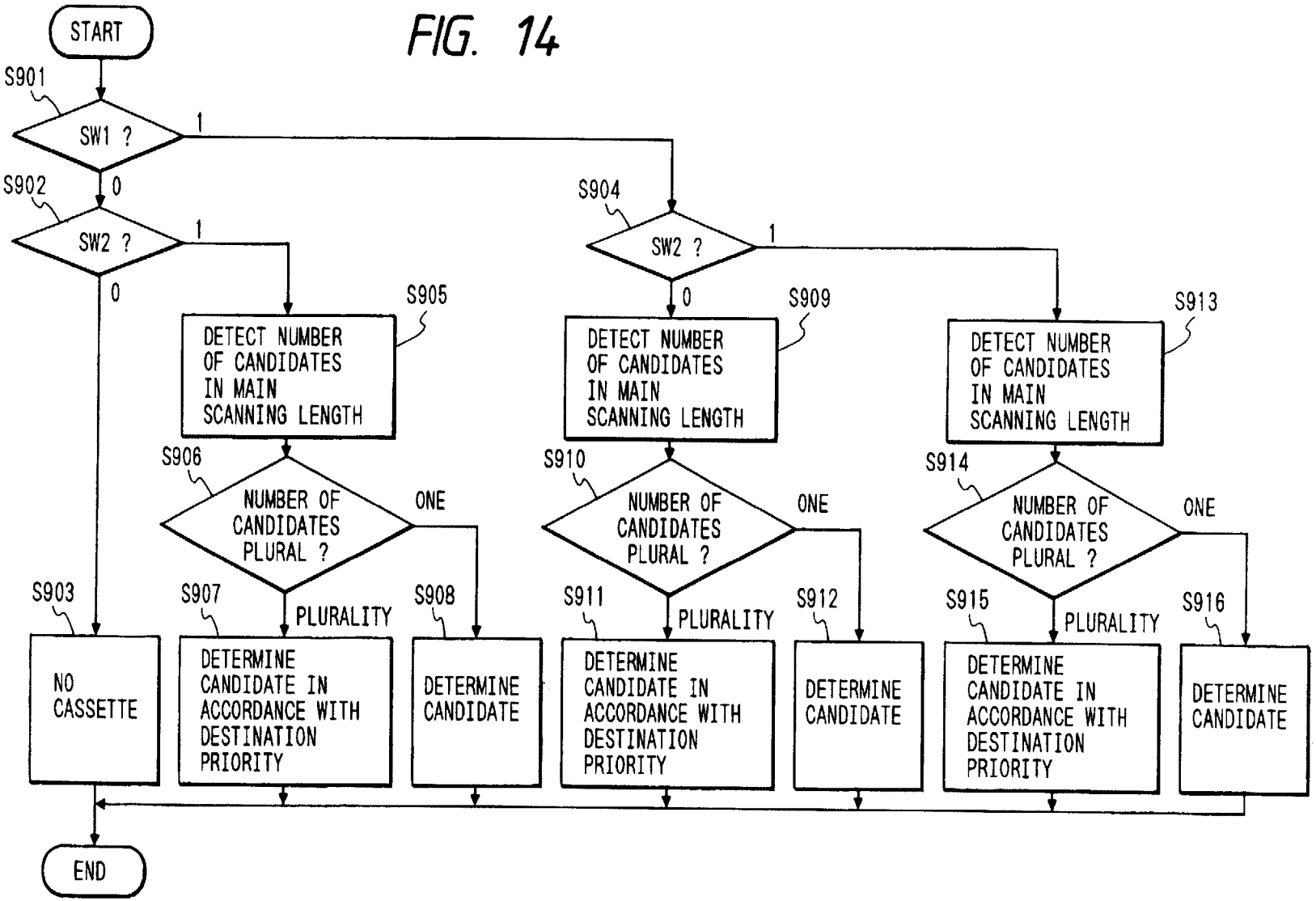
FIG. 14 is a flow chart showing the function of a fifth embodiment of the present invention.

FIG. 14 is a flow chart showing the sheet size detecting operation of the fifth embodiment. A step S901 discriminates the state of the switch SW1, and, if it is "1", a step S904 discriminates the state of the switch SW4. If the switch SW1 is "0", a step S902 discriminates the state of the switch SW2. If the step S902 identifies the state of the switch SW2 as "0", a step S903 identifies a state without the cassette and stores a state code indicating the absence of the cassette in the cassette status memory area of the RAM 209.

On the other hand, if the step S902 identifies the state of the switch SW2 as "1", a step S905 counts the number of the candidate sheet sizes within a sub-scan length region of 232 to 335 mm, and a step S906 discriminates the number of the candidates in order to limit the candidates by the main scan length. If there exists only one candidate, a step S908 adopts the candidate and stores the cassette code of thus determined candidate in the cassette status memory area of the RAM 209. If the step S906 identifies plural candidates, a step S907 determines a candidate according to an order of priority determined in consideration of the destination, and stores the cassette code of thus determined candidate in the cassette status memory area of the RAM 209.

On the other hand, if the step S901 identifies the state of the switch SW1 as "1", a step S904 discriminates the state of the switch SW2. If it is identified as "0", a step S909 counts the candidate sheet sizes in a sub-scan region exceeding 335 mm, and a step S910 discriminates the number of the candidates, in order to limit the candidates by the main scan length. If there is only one candidate, a step S912 adopts the candidate and stores the cassette code of thus determined candidate in the cassette status memory area of the RAM 209. If the step S910 identifies plural candidates, a step S911 determines a candidate according to an order of priority in consideration of the destination of the apparatus, and stores the cassette code of thus determined candidate in the cassette status memory area of the RAM 209.

On the other hand, if the step S904 identifies the state of the switch SW2 as "1", a step S913 counts the number of the candidate sheet sizes in a sub-scan length region not more than 232 mm, and a step S914 discriminates the number of the candidates in order to limit the candidates by the main scan length. If there is only one candidate, a step S916 adopts the candidate and stores the cassette code of thus determined candidate in the cassette status memory area of the RAM 209. If the step S914 identifies plural candidates, a step S915 determines a candidate according to an order of priority determined in consideration of the destination of the apparatus, and stores the cassette code of thus determined candidate in the cassette status memory area of the RAM 209.

In the fifth embodiment, as explained in the foregoing, the sheet size is detected according to the edge positions of the sheet defined by the lateral defining plates 13a, 13b and the rear end defining plate 14, and, if the selection of a regular-sized sheet is required from plural candidates, a regular-sized sheet matching the destination of the apparatus is selected from these candidates, according to an order of priority determined in advance in consideration of the destination.

Thus, in the third to fifth embodiments explained in the foregoing, the sheet size is automatically detected based on a first electrical signal corresponding to the set value of the sheet width setting means and a second electrical signal corresponding to the set value of the sheet length setting means. Consequently, there can be provided a sheet size detecting device, capable of properly detecting the sheet size with a simple structure, and without the necessity for preparing an exclusive cassette for each sheet size.

[Sixth embodiment]

Figure 15:
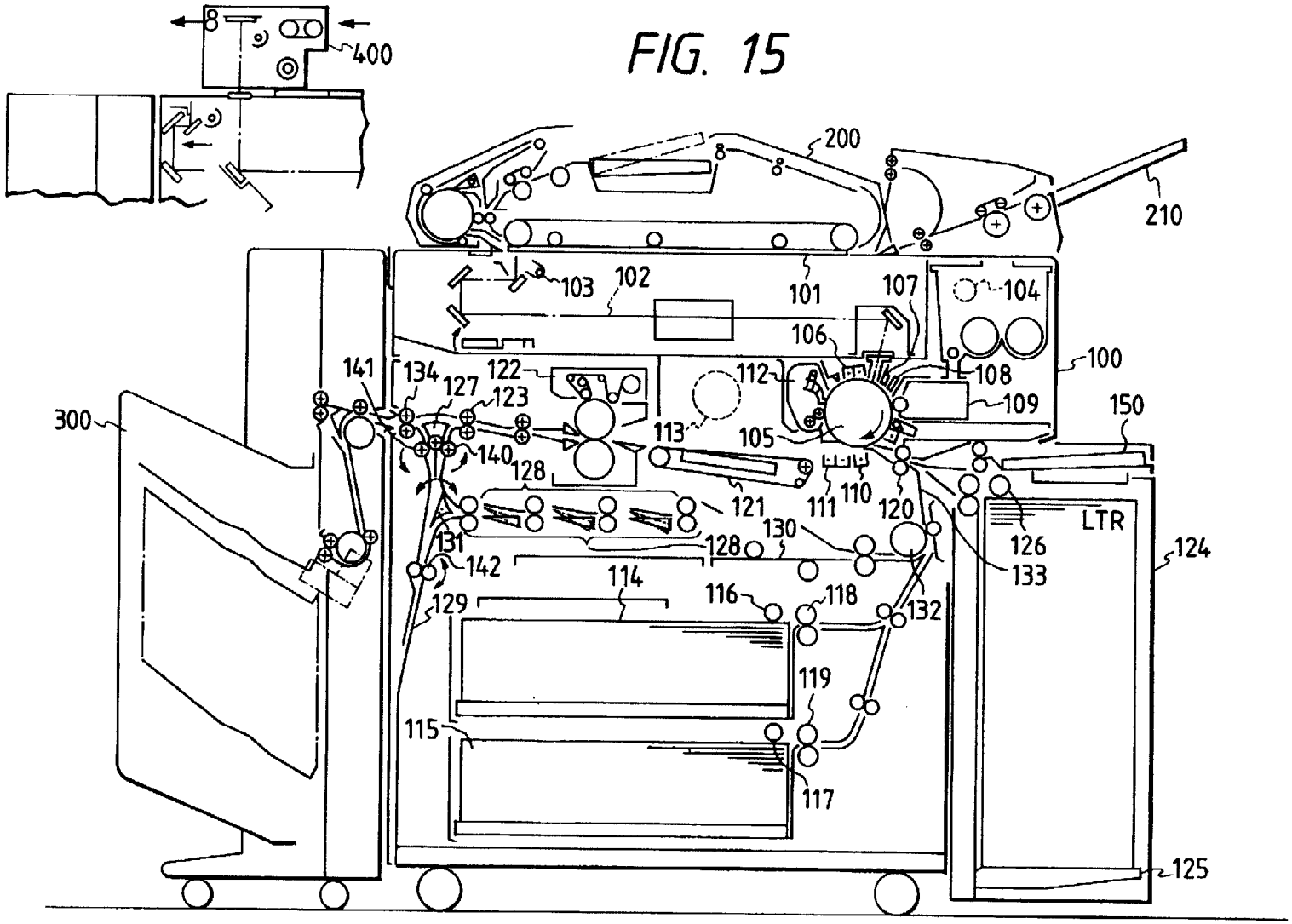
FIG. 15 is a cross-sectional view of the main body of the copying apparatus in a sixth embodiment of the present invention.

Next, a sixth embodiment of the present invention will be explained below. FIG. 15 is a cross-sectional view of the main body of a copying apparatus constituting a sixth embodiment of the present invention.

The system shown in FIG. 15 is composed of a main body 100 of the copying apparatus, a recycling document feeder (RDF) 200 for automatic feeding of the originals, a sorter 300, and an automatic computer form feeder (FCC) 400. The RDF 200, sorter 300 and CFF 400 can be combined with the main body 100 in any arbitrary combination.

A glass plate 101 constitutes an original supporting table. An optical system 102 constituting image reading means is composed of an original illuminating lamp 103, scanning mirrors, a lens, a motor 104, etc., whereby the original is illuminated by the lamp 103 with a scanning motion by the motor 104, and the light reflected from the original is guided by the scanning mirrors and the lens to a photosensitive drum 105. An optical or mechanical sensor constituting detection means to be explained later is provided in a predetermined position.

Around the photosensitive drum 105, there are provided a high voltage unit 106, a blank exposure unit 107, a potential sensor 108, a developing unit 109, a transfer charger 110, a separating charger 111 and a cleaning unit 112, whereby image recording means is constituted.

The photosensitive drum 105 is rotated by a main motor 113 in a direction indicated by an arrow in FIG. 15, and is charged by the high voltage unit 106. Upon receiving the reflected light from the original through the optical system 102, there is formed an electrostatic latent image, which is developed into a visible toner image by the developing unit 109.

A recording sheet is fed from an upper cassette 114 or a lower cassette 115, through pickup rollers 116, 117 and feed rollers 118, 119, into the main body 100, and is supplied to the photosensitive drum 105 with such timing control by registration rollers 120 that the front end of the toner image coincides with that of the recording sheet. Thus, the toner image is transferred onto the sheet by the transfer charger 110.

After the image transfer, the recording sheet is separated by the separating charger 111 from the photosensitive drum 105, then guided to a fixing unit 122 by a conveyor belt 121 and subjected to image fixation with heat and pressure. Subsequently, the sheet is discharged by discharge rollers 123 from the main body 100. The surface of the photosensitive drum 105 is cleaned by the cleaning unit 112.

In the main body 100, there is provided a deck 124 capable of containing, for example, 4000 recording sheets. A lifter 125 is elevated according to the amount of the recording sheets in such a manner that a feed roller 126 is always in contact with the sheets. Also provided is a multiple manual sheet feeding unit 150 capable of containing 100 sheets.

A discharge flapper 127 serves to switch the sheet path to a side for two-side or multiple recording or to a discharging side (to the sorter 300), and the recording sheet discharged by the discharge rollers 123 is guided, by the flapper 127, to the side for two-side recording or the side for multiple recording. A lower transport path 128 guides the recording sheet discharged from the discharge rollers 123 to a re-feed tray 130, after sheet inversion in an inverting path 129.

A multiple flapper 131 is provided for switching the paths for two-side recording and for multiple recording. When it is inclined to the left, the recording sheet is directly guided to the lower transport path 128 without passing the inverting path 129. A roller 132 is provided for feeding the sheet toward the photosensitive drum 105 through a path 133. Rollers 134 are positioned close to the flapper 127, for discharging the recording sheet guided to the discharge side by the discharge flapper 127.

In the two-side or multiple recording, the discharge flapper 127 is raised to store the recording sheet, after recording, in the re-feeding tray 130 in an inverted state through the transport paths 128, 129. In the two-side recording, the multiple flapper 131 is inclined to the right, while, in the multiple recording, the flapper 131 is inclined to the left. In the succeeding rear-face recording operation or in the second recording in the multiple recording operation, the recording sheets contained in the re-feeding tray 130 are supplied, in succession from the bottom, through the feeding roller 132 and the path 133, to the registration rollers 120 in the main body 100.

In inverted discharge of the recording sheet from the main body 100, the discharge flapper 127 is elevated while the flapper 131 is inclined to the right, whereby the recording sheet after recording operation is transported into the path 129. After the rear end of the sheet passes a first transport roller 140, it is transported to a second transport roller 141 by an inverting roller 142, and is discharged in the inverted state by the discharge rollers 134. There is also provided a reservation tray 210.

Figure 16:
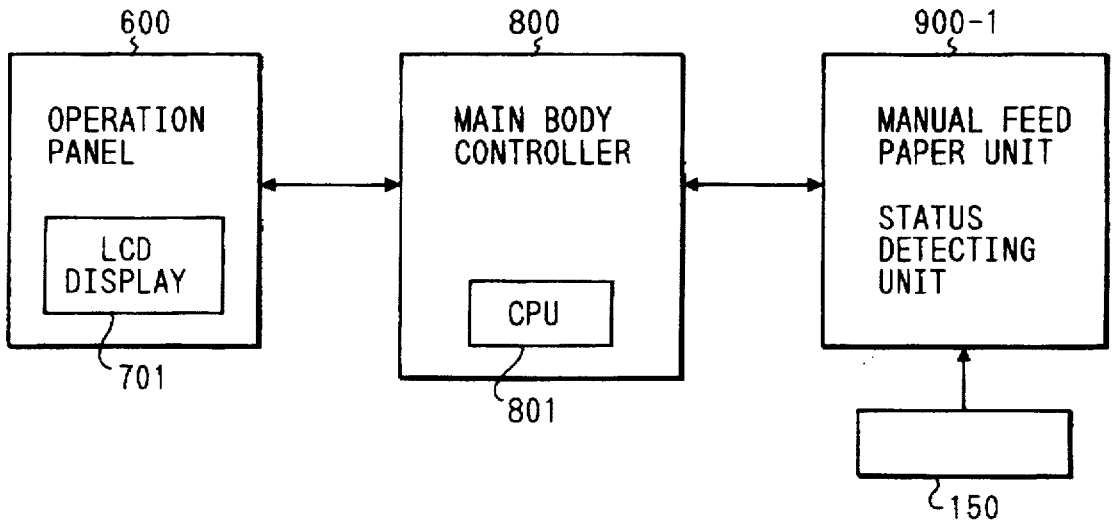
FIG. 16 is a schematic block diagram of the sixth embodiment.

FIG. 16 is a schematic block diagram of the control system of the main body 100.

A main body controller 800, of which details will be explained later in relation to FIG. 16, effects overall control of the main body 100. An operation panel 600 is provided with keys for setting various copying modes, indicators for displaying the set state of the copying modes, and an LCD display unit 701 for message display of various operation states. A status detection unit 900-1 for the manual sheet feeding unit detects the presence or absence of manually fed sheet and the width thereof, and sends the detected information to the controller 800.

Figure 17:
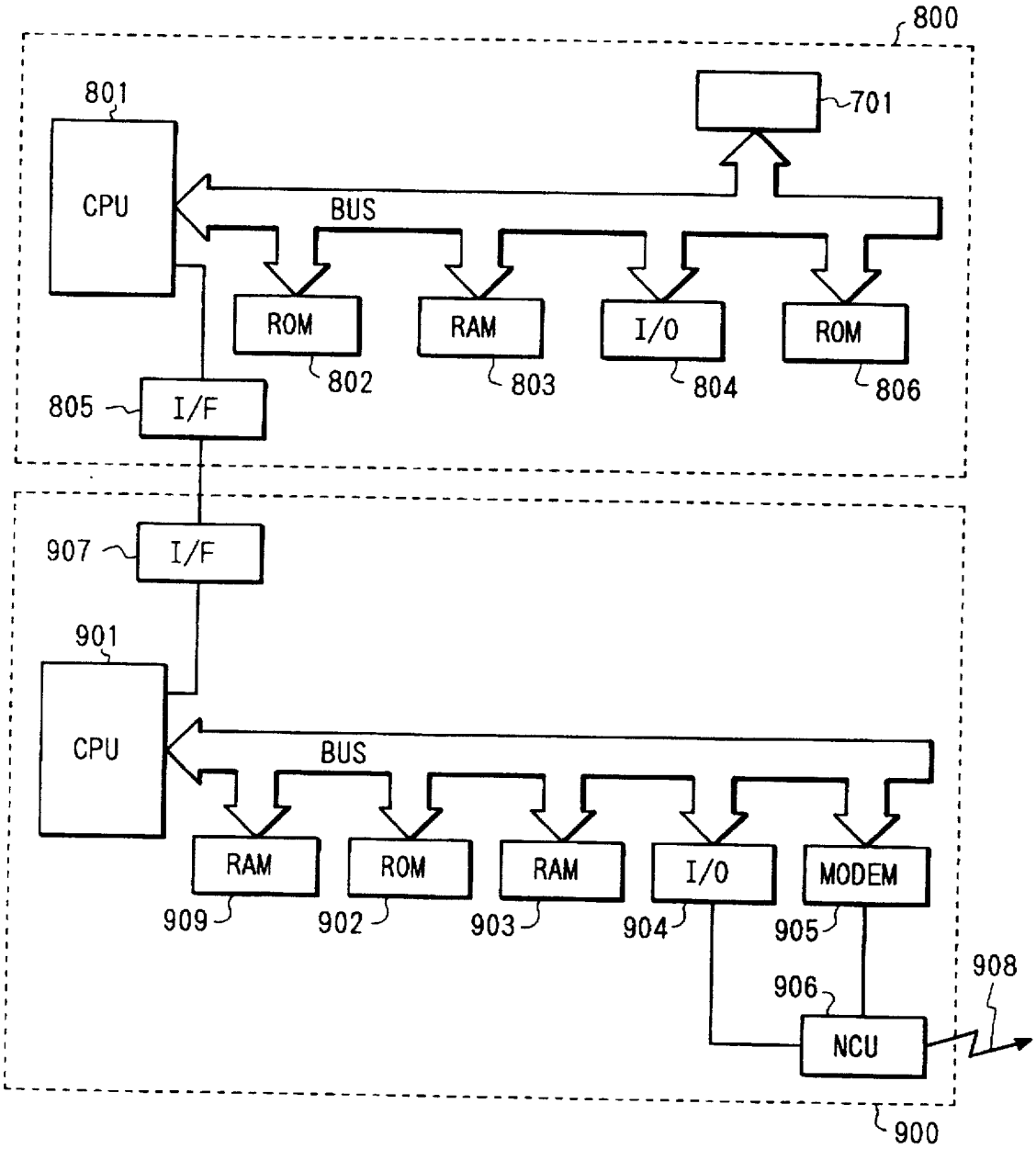
FIG. 17 is a block diagram of the control system of the sixth embodiment.

FIG. 17 is a block diagram showing the details of the main body controller 800 shown in FIG. 16.

There are provided a CPU 801 for controlling the main body 100, and a ROM 802 storing the control sequence for the main body 100. According to the control sequence stored in the ROM 802, the CPU 801 controls various units connected through a bus. There are further provided a RAM 803 constituting a main memory, for storing display data externally entered by communication process and as a work memory area; an I/O port 804; an interface 805; and a ROM 806 storing graphical and font data for display on an LCD unit 701 to be explained later. The CPU 801 executes the control of the main body of the copying apparatus, the control of the communication with external units, the control on display, etc., according to control programs stored in the ROM 802.

The I/O port 804 sends control signals from the CPU 801 to the loads such as the main motor 113, and receives signals, for example, from the fixing unit 122 for supply to the CPU 801. Communication control means 900 for a public line 908 is controlled by a CPU 901. It is connected with the main body 100 through an interface 907 of a format RS-232C. When data are transferred from the copying apparatus through the interface 907, in response to a request therefor, the data are temporarily retained in a RAM 902 provided in the communication control means 900, then connection is made with an external line by an NCU 902 after the data transfer, and the data are transferred to the exterior through a modem 905 and the NCU 906. Also, in case of data transfer from the exterior, the data are temporarily retained in a RAM 903, and are transferred to the copying apparatus through the interface 907, in response to a request from the copying apparatus. The above-mentioned data mean those stored in the main body 100, and the above-mentioned request may occur in case of a control error or a sheet jamming in the main body 100 or in case of regular reporting time, or may occur by the request from an external administration unit. There are further provided an I/O port 904, and a RAM 909.

The controller 800 of the main body 100 and the communication control means 900 for the public line 908 are connected through interfaces 805, 907, for mutual exchange of the control data.

In the copying apparatus of the above-explained configuration, when the detecting unit 900-1 detects the width of the manually fed sheets, there can be recognized the candidates of the sizes of the manually fed sheets. Then, the size of the sheets supplied from the multiple manual sheet feeding tray 150 can be recognized by selecting one of the candidates with a key of the operation panel 600. Thus, regardless whether any of the automatic sheet selection mode, the multiple copying mode and the two-side copying mode is selected by the operation panel 600, the CPU 801 allows execution of the copying sequence with the sheet feeding from the manual sheet feeding means, so that, in any of the copying modes, the copying sequence can be executed with the manually fed recording sheets.

Also, since the RAM 803 memorizes the designated size of the manually fed sheets, the manual sheet feeding with thus memorized sheet size can be instructed in continuation.

Also, the display control means reads the candidate size data, memorized in the RAM 803, and displays the size data on the display unit according to a predetermined order of priority, it is rendered possible to display a desired candidate size from the candidate size data corresponding to the detected sheet width.

Also, as the CPU 801 reads the candidate size data, memorized in the RAM 803, in succession for display on the LCD display unit 701 based on the order of priority according to the width information detected by the variable resistor 153, it is rendered possible to display a desired manually fed size, as the highest priority candidate, among the candidate size data corresponding to the detected sheet width.

Furthermore, as the display control means reads and displays the candidate size data, memorized in the memory means, on the LCD display unit 701 as the highest priority candidate, it is rendered possible to display a desired manually fed size, which has been selected before, as the highest priority candidate.

Furthermore, as the CPU 801 executes the prioritized display of the candidate size data according to the enabling or disabling instruction for such display by a key of the operation panel 600, the display with the priority can be selectively given.

Figure 18:
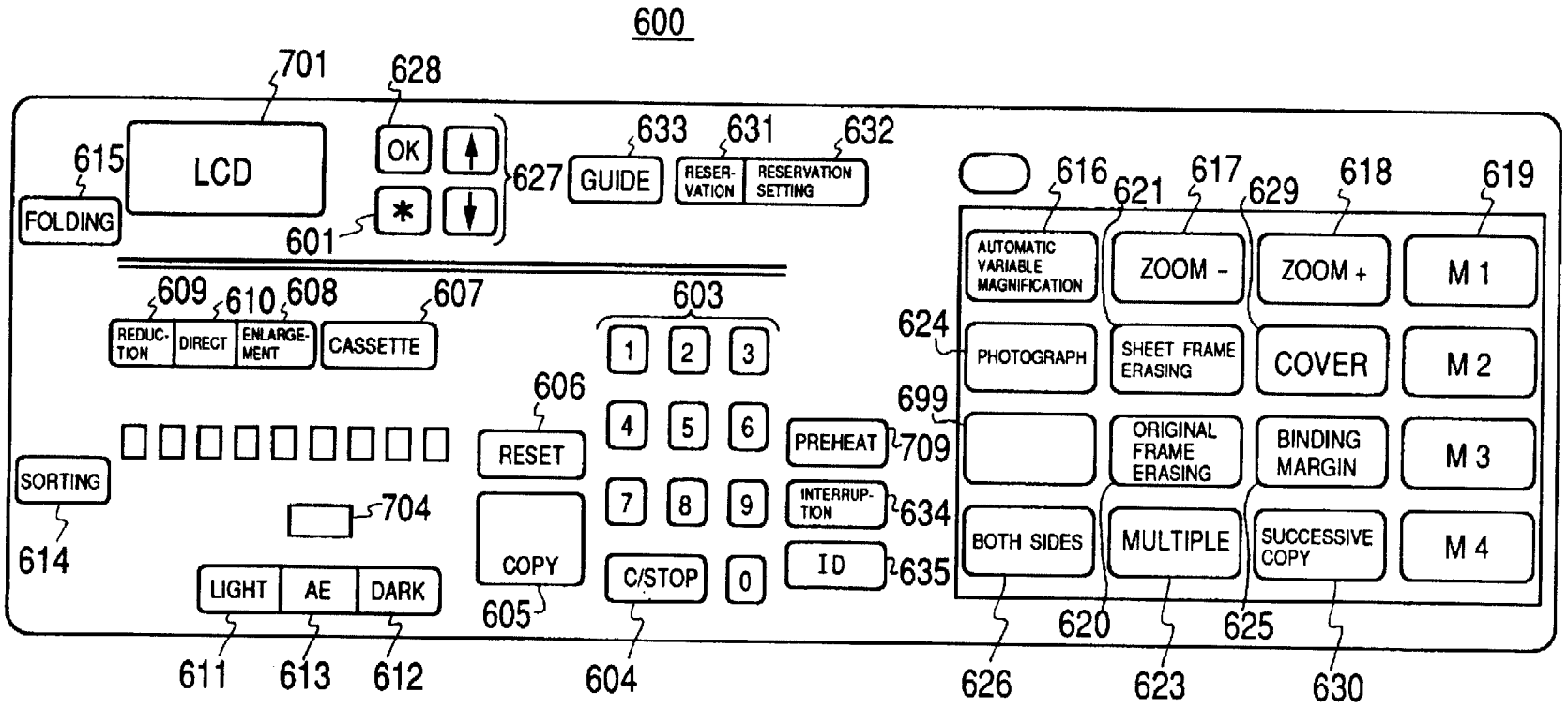
FIG. 18 is a plan view showing an example of key arrangement in the operation panel of the sixth embodiment.

FIG. 18 is a detailed plan view of the operation panel 600 shown in FIG. 16, mainly used in the selection of the copying modes.

As asterisk (*) key 601 is used in the mode setting such as setting of the binding margin or the size of erasure of a frame in the original image. A cursor (up/down) key 627 is used for selecting items in the mode setting. An OK key 628 is used for fixing the items in the mode setting. An all reset key 606 is used for restoring the standard mode, or returning from the all shut-off state of the standard mode. A clear/stop key 604 serves as the clear key in the stand-by state, and as the stop key during the image recording. It is also used for cancelling the set copy number, or for interrupting a continuous copying operation, and the copying operation is interrupted after completion of a copying cycle which is on-going when the key is actuated. There are also provided a copy start key 605; and numeral keys 603 to be used for setting the copy number, or for setting the asterisk key mode.

Memory keys 619 are used for registering modes frequently used by the operator. In the illustrated configuration, there can be registered four modes M1–M4. Copy density keys 611, 612 are used for manual adjustment of the copy density. An AE key 613 is used for automatic adjustment of the copy density according to the original density, or switching from the automatic density control mode to the manual density control mode. A copy sheet selection key 607 is used for selecting the upper cassette 114, lower cassette 115, paper deck 124 or multiple manual sheet feeding tray 150. If the key 607 is depressed when originals are placed on the RDF 200, there is selected the automatic paper cassette selection (APS) mode, whereby a cassette containing sheets same in size as the originals is automatically selected. A same size key 610 is used in case of same size copying mode.

An automatic variable magnification key 616 is used in case of automatically enlarging or contracting the original image according to the size of the designated recording sheet. A both-side key 626 is used for forming two-side copies from one-side originals or two-side originals or forming one-side copies from two-side originals. A binding margin key 625 is used for forming a binding margin of a predetermined width, at the left-hand side of the recording sheet. A photograph key 624 is used in case of copying a photograph original. A multiple key 623 is used in case of synthesizing images on a same side of the recording sheet from two originals. An original frame erasing key 620 is used for erasing the frame of a regular-sized original, and the original size is set by the asterisk key 601. A sheet frame erasing key 621 is used for erasing the frame of the sheet, according to the recording sheet size. There are also provided zooming keys 617, 618.

A cover mode setting key 629 is used in case of preparing a cover sheet or a bottom cover sheet or inserting intermediate sheet. A page succession key 630 is used for successively copying left and right pages of a bound original. A key 614 is used for selecting the sheet discharging in the stapled sort mode, sort mode or grouped mode. If a stapling sorter is connected, the key is used for selecting one of the modes or cancelling the selected mode. A reservation key 631 is depressed in starting the copying mode setting for reserved originals placed on a reservation tray 210, or for cancelling the reservation.

A reservation setting key 632 is used for fixing the reservation mode. A guide key 633 is used for displaying an explanation of the function corresponding to each key, on the message display. A message display 701 of liquid crystal type (LCD) displays information relating to the copying, in characters or graphic patterns in 96×192 dots. It displays, for example, the copy number set by the numeral keys 603; the copying magnification set by the enlarging or reducing keys 608, 609, a same size key 610 or zooming keys 617, 618; the sheet size selected by the selection key 607; messages indicating the state of the main body 100; guide messages indicating the operation procedure; and set states of various modes. An AE indicator 704 is turned on when the AE (automatic density control) mode is selected by the AE key 613. A preheating indicator 709 is turned on in the course of pre-heating. There are also provided an interruption key 634, and an ID key 635.

When the RD, 200 is used in the standard mode, there are selected one copy, automatic density control mode, automatic sheet selection, same size copying, and one-side copy being made from one-side original. When the RDF 200 is not used in the standard mode, there are selected one copy, manual density control, same size copying, and one-side copy being made from one-side original. Whether the RDF 200 is used or not is determined by whether the originals are set thereon. A prohibition key 699 will be explained later.

In the following there will be explained the data exchange between the copying apparatus and the communication control device.

The current status of the main body 100, such as the on/off state of the power supply, whether the copying operation is enabled, the set copy number, whether the copying sequence is currently executed etc. is constantly reported to the communication control means 900. Also, the sheet jamming or other abnormality disabling the copying operation is also reported. The communication control means 900 is provided with predetermined data transfer conditions, and automatically transfers the data to the exterior in response to the report of an abnormality from the main body 100 if such transfer of abnormality report is predetermined. The transferred data are common data consisting of the ID of the copying apparatus, reason for transfer, history of sheet jammings classified by color and size etc., regardless of the reason for transfer. The history of sheet jamming consists of the date and time of jamming, total copy number jammed, and a sheet jamming code, and includes 30 prior reports at maximum, sent previously from the copying apparatus and accumulated in the communication control means 900.

Such data transfer is made in case of an abnormality as mentioned above, or when sheet jams occur a predetermined number of times, or when sheet jams of a same sheet jam code occur in succession, or when such transfer is requested from the outside.

In the following explained is the control operation in case a sheet jam occurs in the course of operation of the main body 100.

When the CPU 801 identifies that a sheet jam has occured in the course of operation of the main body 100, the sheet jam information including the sheet jam code, the time of occurrance of sheet jam and the current total copy number is transferred, through the interfaces 805, 907 to the RAM 903 of the communication control means 900 and retained in the RAM 903. The CPU 901 identifies the predetermined condition for transfer, and transfers the information to the exterior through the modem 905 and the NCU 906, when the condition for transfer is met. The transferred data consist of the ID of the main body 100, reason for transfer, sheet jam information, information on color and size, and details of copy numbers.

As explained above, the communication control means 900 retains the internal data of the main body 100, the sheet jam information, the history of abnormality in the copying operation of the main body 100, etc. in a RAM with a back-up power supply such as the RAM 903, and transfers the data retained in the RAM 903 in response to an external request, thereby enabling external diagnosis and administration of the copying apparatus.

However, such external diagnosis and administration cannot be properly executed if the content of the RAM is affected, for example, by a lowered voltage of the back-up battery.

It is nevertheless possible, as will be explained later, to inspect the operation status of the RAM 903 with the back-up power supply and to automatically report an abnormality therein to the externally controlling host computer.

In the following there will be explained the details of the present embodiment. At first an explanation will be given on the state detecting means 900-1 for the manual sheet feeding unit.

Figure 19A:
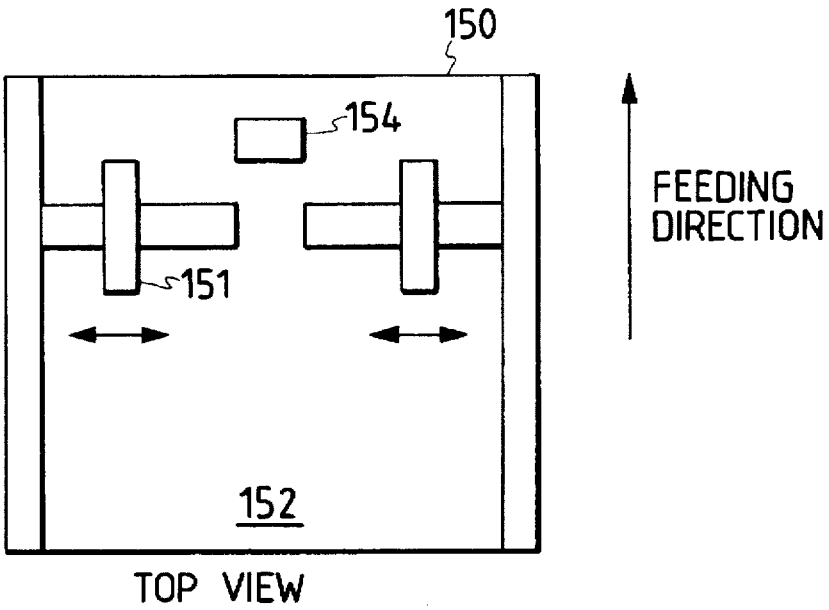
FIGS. 19A and 19B are plan views showing the configuration of a multiple manual sheet feeding unit in the sixth embodiment.
Figure 19B:
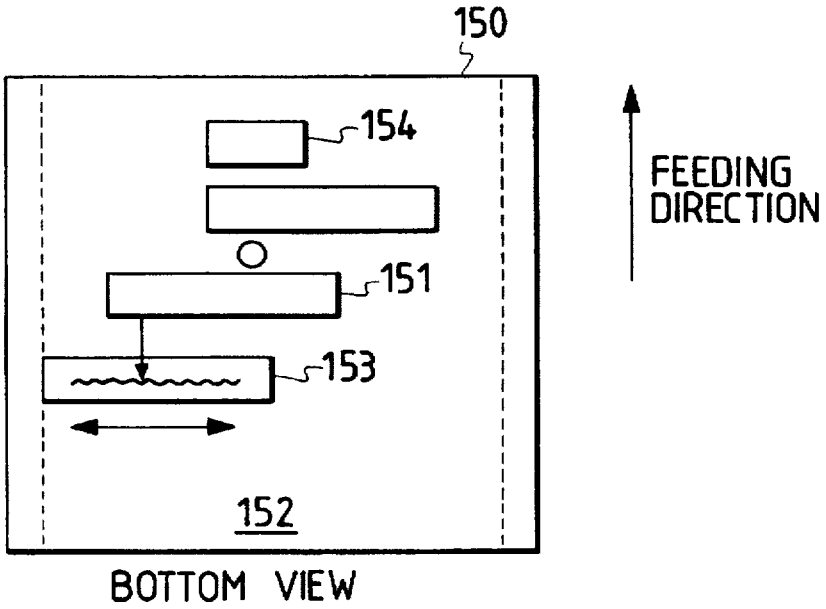

FIGS. 19A and 19B are plan views of the multiple manual sheet feeding unit 150. Sheet defining guides 151 are rendered slidable and define the width of the recording sheets stacked on a manual feed tray 152. A width detecting variable resistor 153 is connected to the guide 151, and detects the width in a continuous manner from the minimum to maximum sheet size. The sheet width detected by the variable resistor 153 is represented by an analog voltage from 0 to 5 V, and the CPU 801 determines a sheet size group, based on the A/D converted voltage and utilizing a conversion table shown in FIG. 20.

A sensor 154 for detecting the presence of the sheet, is turned on or off respectively when a sheet is present or not on the manual feed tray 152. The detection signal from the sensor 154 is supplied to the CPU 801.

Then explained is the method of designating the size of the recording sheets placed on the manual sheet feeding unit.

When the multiple manual sheet feeding unit 150 is selected by the copy sheet selection key 607, the display unit 701 displays, as shown in FIG. 21, a message requesting the designation of the sheet size. Also, the sheet size display unit 702 displays the sheet sizes to be selected.

The sheet sizes are displayed in succession, from a predetermined sheet size group, by the depressions of the cursor key 627. The sheet size group is determined from the sheet width detected by the variable resistor 153.

The sheet size is fixed by the depression of the OK key 628 when a desired sheet size is displayed.

FIG. 22 is the display at the cassette selection. A display area 704 indicates the size A4 registered for the manually fed sheets.

Figure 23:
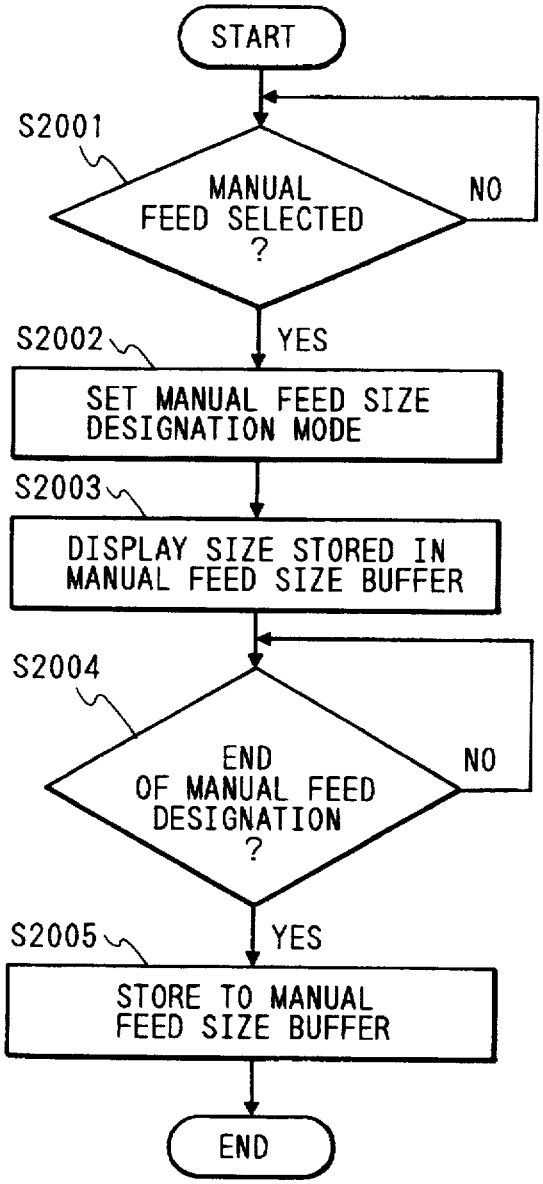
FIG. 23 is a flow chart showing the function of the sixth embodiment.

FIG. 23 is a flow chart showing the control sequence of the present embodiment.

At first, there is discriminated whether the manual feed mode is selected by the copy sheet selection key 607 (S2001), and, if selected, a manual feed size designating mode is started (S2002). Then, a display area 703 in FIG. 21 displays a size memorized in a manual feed size buffer of the RAM 803 (S2003).

Then, the sizes related to the variable resistor 153 are displayed in succession on the display unit 701 by the manipulation of the cursor key 627, and the designation of the manual feed size by the OK key 628 is awaited (S2004). After the designation, the designated size is stored in the manual feed size buffer and is displayed in a position 704 in the display unit 701 (S2005). The sequence is thus terminated.

[Seventh embodiment]

Figure 24:
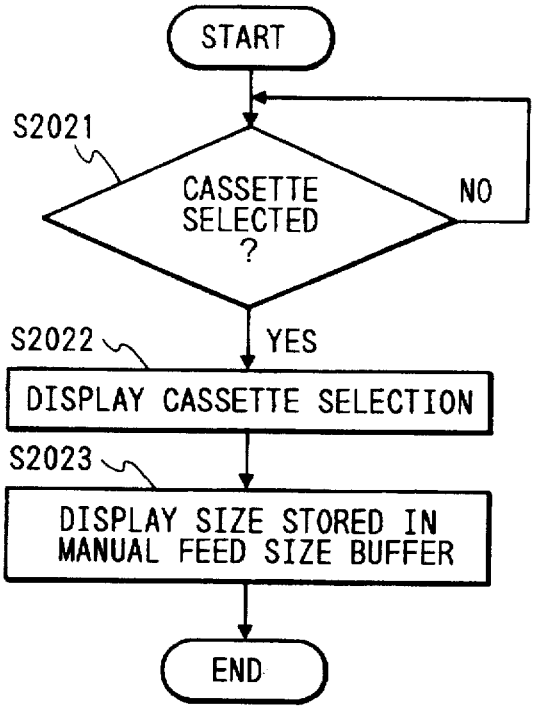
FIG. 24 is a flow chart showing the function of a seventh embodiment of the present invention.

FIG. 24 is a flow chart of the control sequence of a seventh embodiment of the present invention, of which configuration is the same as that of the sixth embodiment shown in FIGS. 15 to 22. In the following the differences from the sixth embodiment will be explained with reference to FIG. 24.

At first, there is discriminated whether the copy sheet selection key 607 has been depressed (S2021), then displayed is the cassette selecting image frame shown in FIG. 22 (S2022), and the size of the aforementioned manual feed size buffer in the display position 704 (S2023).

In the sixth and seventh embodiments explained above, there is provided display means for displaying the sheet size, stored in the memory means for memorizing the sheet size designated by the sheet size designating means, whereby it is no longer necessary to select the sheet size each time the manual sheet feeding means is used, and it is also rendered possible to prevent erroneous copying or sheet jamming, resulting from eventual difference between designated sheet size and the size of the actually placed sheets.

[Eighth embodiment]

In the following there will be explained a first manual sheet feeding control, with reference to FIGS. 25 to 28A and 28B. The present eighth embodiment is the same as the foregoing sixth embodiment in the configurations shown in FIGS. 16 to 20, so that such configurations are omitted from the following description.

Figure 25:
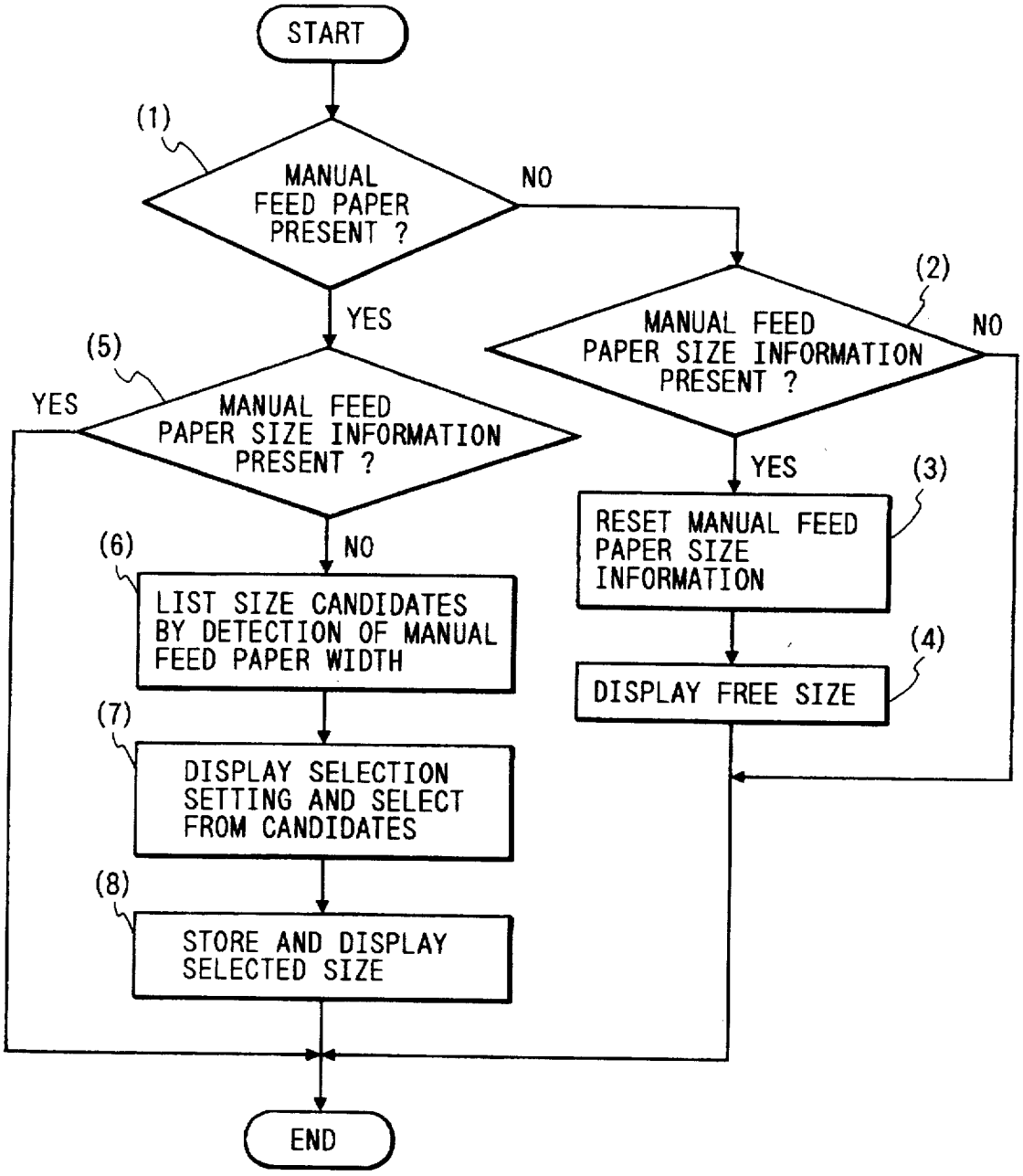
FIG. 25 is a flow chart showing an example of manual sheet feeding control sequence in an eighth embodiment of the present invention.

FIG. 25 is a flow chart showing an example of the first manual sheet feeding control sequence in the copying apparatus of the present invention, wherein (1) to (8) indicate process steps. FIGS. 26A and 26B to 28A and 28B show the display states of the display unit 701 shown in FIG. 16.

At first, there is discriminated, based on the output of the detection unit 900-1 shown in FIG. 16, whether manually fed sheets are present on the multiple manual sheet feeding tray 150 (step (I)), and, if not, there is discriminated whether the manual sheet size information is memorized (step (2)). If not, the sequence is terminated.

Figure 26A:
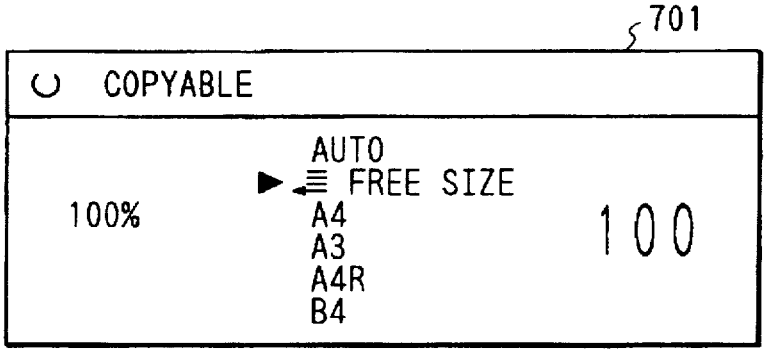
FIGS. 26A, 26B, 27A, 27B, 28A and 28B are views showing various display states of an LCD display unit in the eighth embodiment.

On the other hand, if the discrimination of the step (2) turns out affirmative, the memorized manual sheet size information is reset (initialized) (step (3)), then the LCD display unit 701 displays a default state (free size in this embodiment) is displayed (step (4)) as shown in FIG. 26A, and the sequence is terminated.

On the other hand, if the discrimination in the step 1 turns out affirmative, there is discriminated whether manual sheet size information is memorized (step (5)), and, if yes, the sequence is terminated, but, if not, the candidate sheet sizes are listed, based on the sheet width detected by the detection unit 900-1 (step (6)). If the manually fed sheets are of A4 size, the candidate sizes are A4, A3 and free size.

Figure 27A:
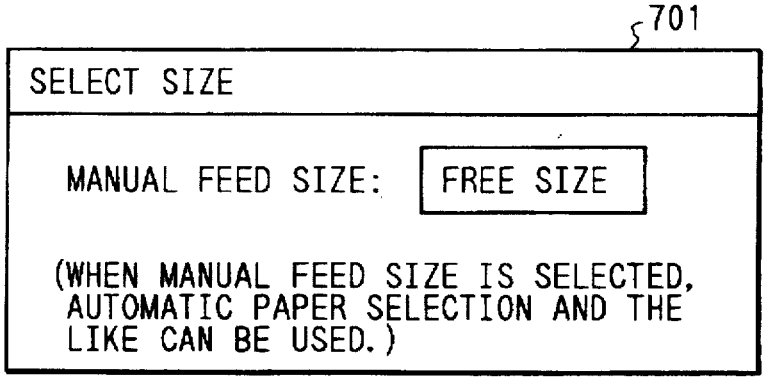
Figure 27B:
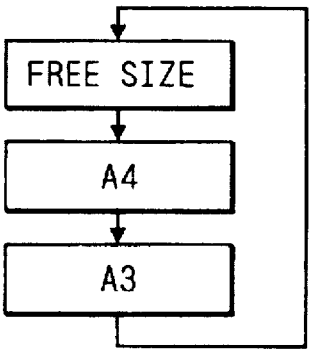
Figure 28A:
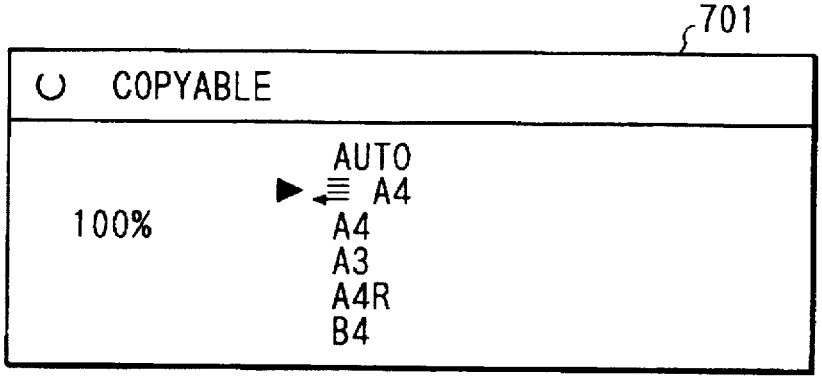
Figure 28B:
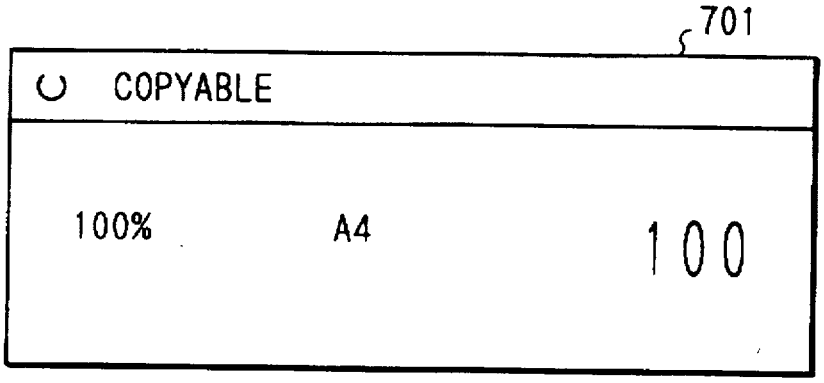

Then, in order to cause the operator to select the size of the manually fed sheet from the candidates, the display unit 701 displays a size selection image as shown in FIG. 27A. In this display, the "free size", "A4" and "A3" are toggle or scroll displayed in response to the depressions of the cursor key 627, as shown in FIG. 27B (cf. FIG. 28A), and the size of the manually fed sheet is selected by the depression of the OK key 628 when the correct size is displayed (step (7)). Then, the selected size is memorized in the RAM 803 and is displayed on the display unit 701 as shown in FIG. 28B (step (8)).

Figure 26B:
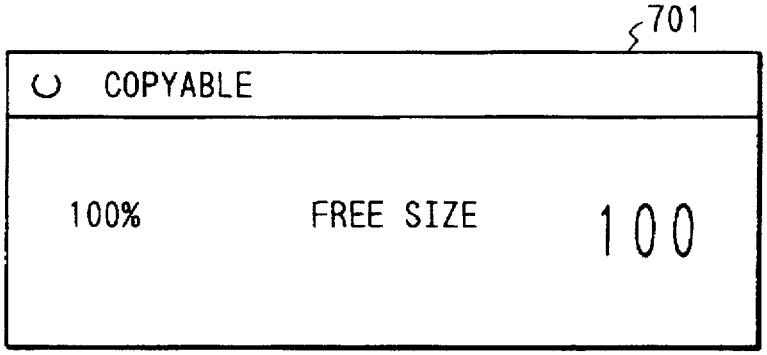

Thus, unless the free size is displayed on the display unit 701 as shown in FIG. 26B, the automatic sheet selection mode or the two-side or multiple copying mode utilizing the intermediate tray can be executed with the manually fed sheets.

In the above-explained embodiment, if the detecting unit 900-1 detects the absence of the manually fed sheet, the memorized size information on the manually fed sheets is reset, but it is also possible to retain the size information on the RAM 803 as will be explained later, during the copying operation.

[Ninth embodiment]

Figure 29:
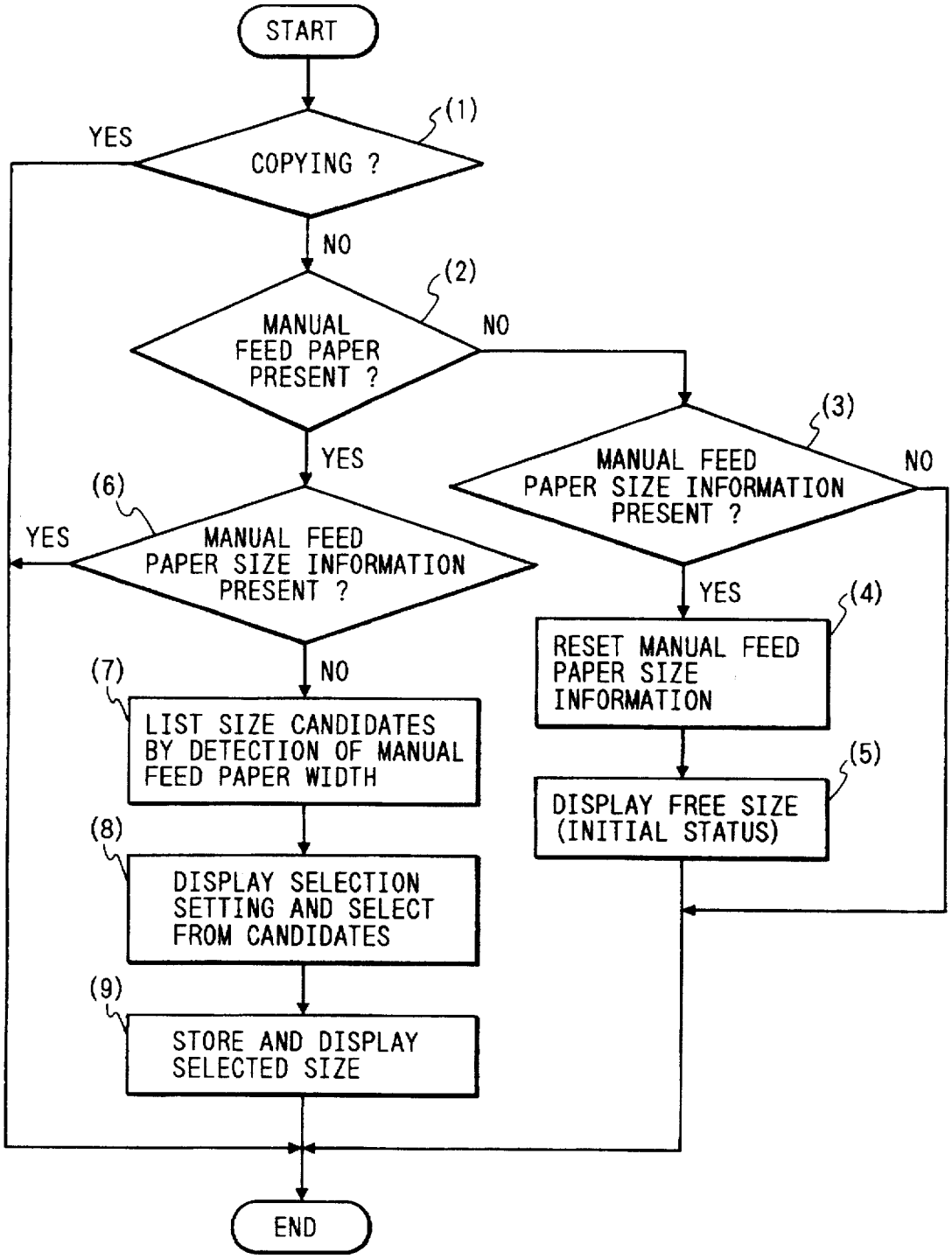
FIG. 29 is a flow chart showing an example of manual sheet feeding control sequence in a ninth embodiment of the present invention.

FIG. 29 is a flow chart showing an example of the control sequence for manual sheet feeding in a ninth embodiment of the present invention, wherein (1) to (9) indicate process steps.

At first, the CPU 801 discriminates whether the main body 100 is in the course of a copying sequence (step (1)), and, if so, this sequence is terminated. If not, there is discriminated whether the manually fed sheet is present in the multiple manual sheet feeding tray 150 shown in FIG. 15, based on the output of the detecting unit 900-1 shown in FIG. 16 (step (2)). If not, there is discriminated whether the size information of the manually fed sheet is memorized (step (3)), and, if not, the sequence is terminated.

On the other hand, if the discrimination of the step (3) turns out affirmative, the memorized size information is reset (initialized) (step (4)), then the manually fed sheet size of default state (free size in this embodiment) is displayed on the display unit 701 as shown in FIGS. 26A and 26B (step (5)), and the sequence is terminated.

On the other hand, if the discrimination in the step (2) turns out affirmative, there is discriminated whether the size information for the manually fed sheet is memorized (step (6)), and, if memorized, the sequence is terminated, but, if not, there are listed the candidate sheet sizes based on the sheet width detected by the detecting unit 900-1 (step (7)). For example, if the manually fed sheet is of A4 size, there are listed three candidates, namely A4, A3 and free size.

Then, a size selecting image as shown in FIG. 27A is displayed on the display unit 701, in order to cause the user to select the size of the manually fed sheet from the candidate sizes. In this display, the "free size", "A4" and "A3" are toggle or scroll displayed by the depressions of the cursor key as shown in FIG. 27B or 28A. The manually fed sheet size is selected by the depression of the OK key 628 when the size is displayed (step (8)). Then, the selected sheet size is memorized on the RAM 803 and is displayed on the display unit 701 as shown in FIG. 28B (step (9)), and the sequence is terminated.

Thus, in case the manually fed sheets in the multiple manual sheet feeding tray 150 are exhausted in the course of a copying operation, the sheets of the same size can be manually fed in continuation, without repeating the size detection of the manually fed sheets and the selection of the candidate sheet sizes.

In the above-explained embodiment, if the manually fed sheet is detected but the size information of the manually fed sheet is not memorized, the size of the manually fed sheet is selected and thus selected sheet size is displayed. However, it is also possible to control the display for selecting the size of the manually fed sheet as shown in FIGS. 27A and 27B in response to the depression of the copy start key 605, when a certain copying mode (two-side or multiple copying modes in which the size of the manually fed sheet has to be fixed) is selected.

It is furthermore possible to control the display for selecting the size of the manually fed sheet as shown in FIGS. 27A and 27B at the timing when a certain copying mode (such as two-side or multiple copying mode, in which the size of the manually fed sheet has to be fixed) is selected.

Also, in the above-explained embodiment, during the copying operation with the manually fed sheets, the size of the manually fed sheet in the succeeding manual sheet feeding is memorized in the RAM 803 even if the manually fed sheet is not detected on the detecting unit 900-1. It is, however, possible also to clear the memorized size information of the manually fed sheet and to set the initialized state, for example, the free size, in response to the depression of the reset key 606 of the operation panel 600.

It is furthermore possible to set the above-explained process of the selection and display of the size of the manually fed sheet into certain operation modes, which can be suitably selected by the operator.

In the above-explained embodiment, in the selection of the size of the manually fed sheet as shown in FIGS. 27A and 27B, the candidate sheet sizes stored in advance corresponding to the sheet width detected by the detecting unit 900-1 are displayed in a fixed order, namely in the order of "free size", "A4" and "A3" in response to the depressions of the cursor key 627, but the candidate sheet sizes and the order of display thereof may be rendered selectable by the user, as will be explained later.

As shown in FIG. 20, the CPU 801 shown in FIG. 17 effects A/D conversion on the analog voltage signal (0–5 V) obtained from the width detecting variable resistor 153, and calculates the sheet size of the manually fed sheet, based on thus converted sheet width data. In the following there will be explained, with reference to FIG. 30, the size designating operation for the manually fed sheet in the copying apparatus of the present invention.

Figure 30:
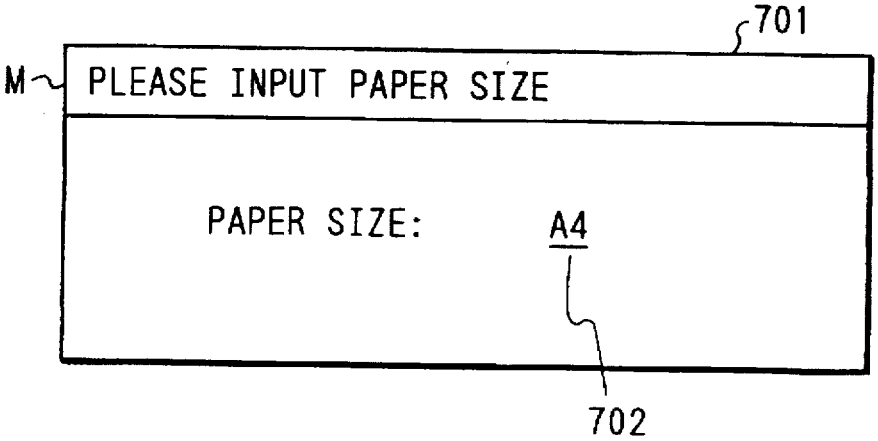
FIG. 30 is a view showing an example of the displayed image frame for designating the manually fed sheet size on the LCD display unit.

FIG. 30 shows an example of the size designating frame for the manually fed sheet on the display unit 701 shown in FIG. 18.

When the multiple manual sheet feeding tray 150 is selected by the sheet selecting key 607 shown in FIG. 18, a message M requesting the designation of the sheet size is displayed on the display unit 701. In the display on the display unit 701, a sheet size 702 to be selected is displayed (size "A4" in FIG. 30). The operator depresses the cursor key 627 in succession, thereby causing the predetermined sheet sizes to be displayed in succession. The sheet sizes are calculated from the sheet width detected by the variable resistor 153. The sheet size is fixed by the depression of the OK key 628 when the size is displayed. In the following there will be explained, with reference to flow charts shown in FIGS. 31 to 33, the preferential display operation of the candidate sheet sizes of the manually fed sheets at the sheet size designation in the copying apparatus of the present invention.

Figure 31:
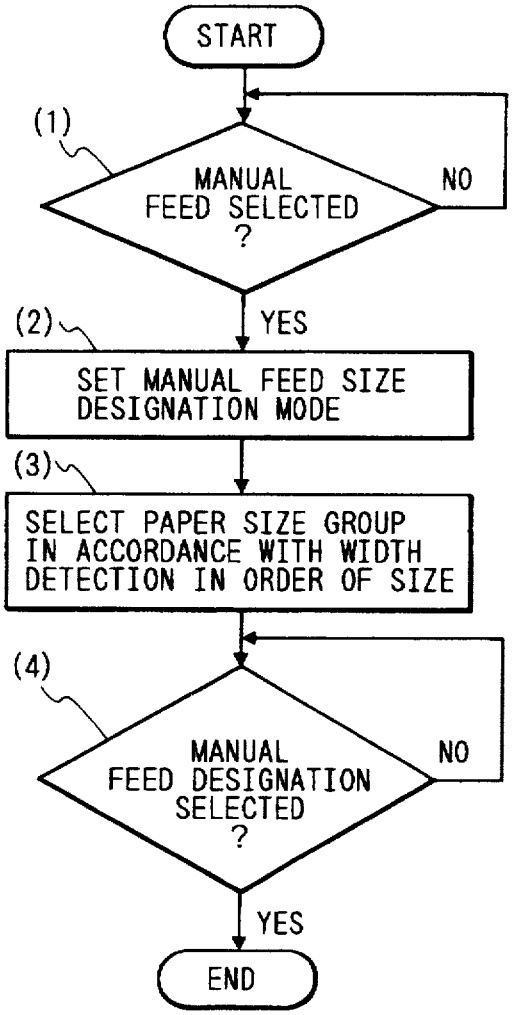
FIG. 31 is a flow chart showing a preferential display sequence for a first candidate for the manually fed sheet in the eighth and ninth embodiments.

FIG. 31 is a flow chart showing a first example of the preferential display sequence of the candidate sheet sizes of the manually fed sheets, wherein (1) to (4) are process steps.

At first, there is discriminated whether the multiple manual sheet feeding tray 150 is selected by the sheet selecting key 607 shown in FIG. 18 (step (1)), and, if selected, the manual feed designation mode is started (step (2)). Thus, the sheet sizes defined in relation to the function of the width detecting variable resistor 153, as shown in FIG. 20 (for example, sizes "A4" and "A3" when the A/D converted value is within a range of 248 to 254) are displayed on the display unit 701 in the order from the smallest one to the largest one, in response to the actuations of the cursor key 627 (step (3)). Then, awaited is the depression of the OK key 628, and the designation process for the manually fed sheet is terminated upon depression of the OK key 628.

Figure 32:
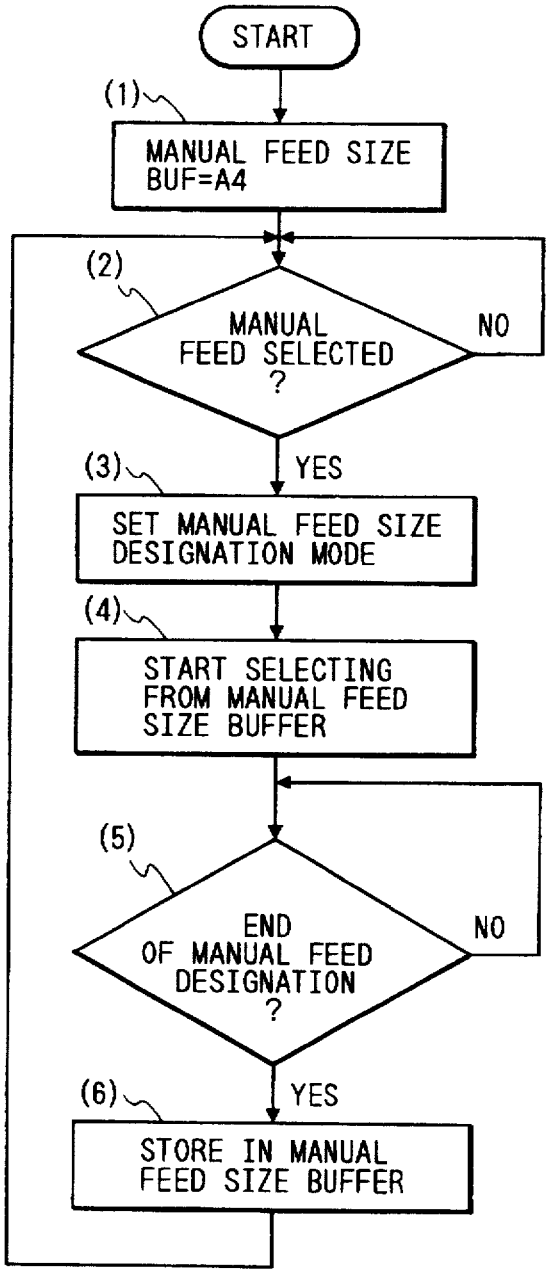
FIG. 32 is a flow chart showing a preferential display sequence for a second candidate for the manually fed sheet in the eighth and ninth embodiments.

FIG. 32 is a flow chart showing a second example of the preferential display sequence for the candidate sheet sizes for the manually fed sheet in the copying apparatus of the present invention.

At first, an initially selected size "A4" is memorized in a buffer BUF for the size information of the manually fed sheet, in the RAM 803 (step (1)). Then, there is discriminated whether the multiple manual sheet feeding tray 150 is selected by the sheet selection key 607 (step (2)), and, if selected, the manually fed sheet size designation mode is started (step (3)). Then, the cursor key 627 is actuated to display at first the content of the buffer BUF storing the previously selected size and then the sheet sizes relating to the function of the width detecting variable resistor 153, in the order of registrations, on the display unit 701 (step (4)). Then, awaited is the depression of the OK key 628 (step (5)). In response to the depression, the selected sheet size is memorized in the buffer BUF of the RAM 803, in order to preferentially display the sheet size as the highest priority candidate for the next manually fed sheet (step (5)), and the sequence returns to the step (step (2)).

Figure 33:
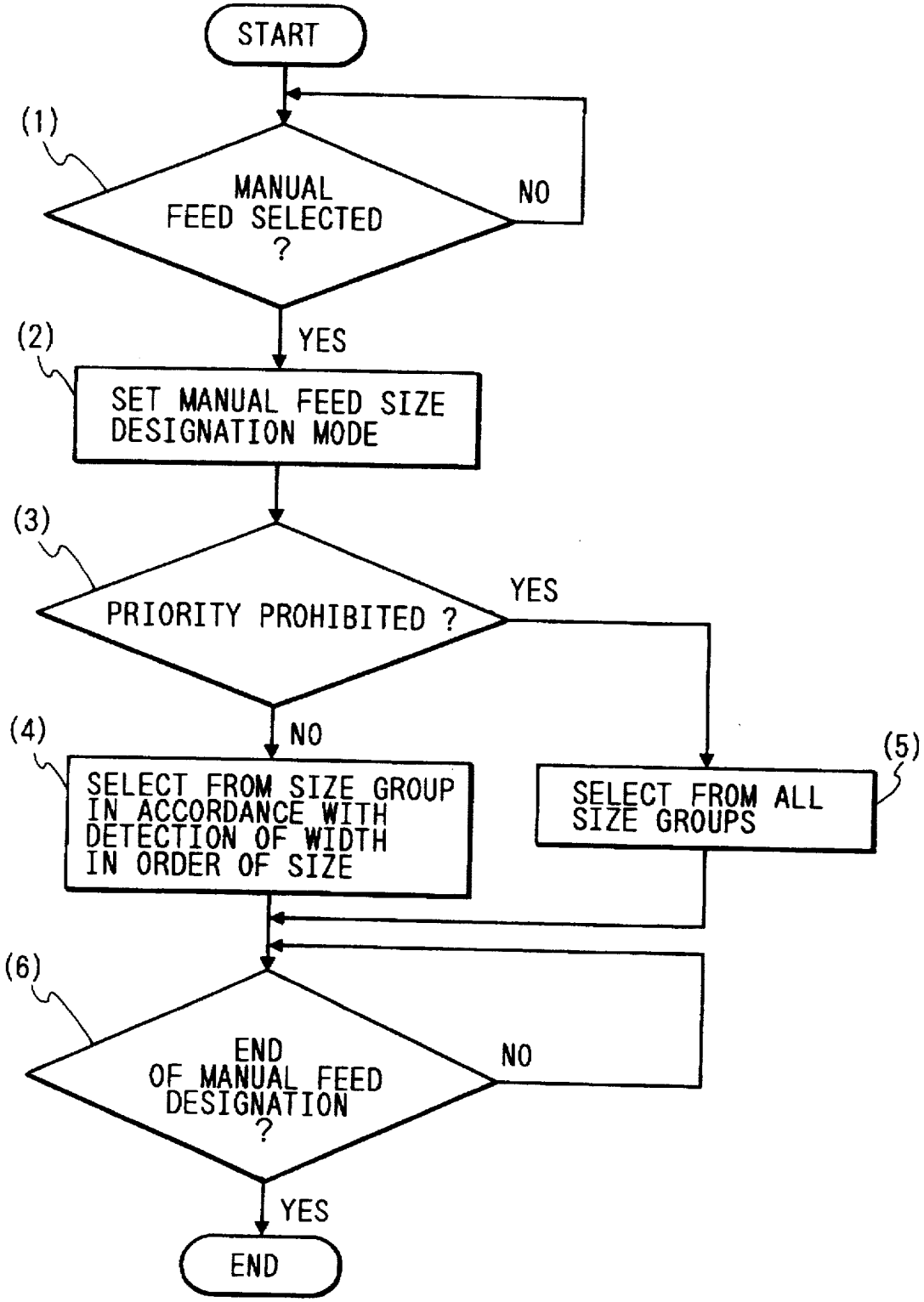
FIG. 33 is a flow chart showing a preferential display sequence for a third candidate for the manually fed sheet in the eighth and ninth embodiments.

FIG. 33 is a flow chart showing a third example of the preferential display sequence of the candidate sheet size of the manually fed sheet in the copying apparatus of the present invention, wherein (1) to (6) indicate process steps.

At first, there is discriminated whether the multiple manual feed tray 150 is selected by the sheet selecting key 607 shown in FIG. 18 (step (1)), and, if selected, the manual sheet size designating mode is started (step (2)). Then, there is discriminated whether the inhibition key 699 for inhibiting the preferential display has been depressed (step (3)). If not depressed, or if the preferential display mode is permitted, the sheet sizes defined by the sheet width detection are displayed in succession from the smallest one to the largest one in the same manner as shown in FIG. 31, on the display unit 701 (step (4)). Then, awaited is the depression of the OK key 628 (step (6)), and the designation sequence is terminated in response to the depression.

On the other hand, if the descrimination of the step (3) turns out negative (preferential display mode inhibited), all the sizes (A3, A4, B3, B5, A4R, LTR, LGL, LTRR, 11*15) are displayed in succession on the display unit 701 (step (5)). Then, awaited is the depression of the OK key 628, and the designation sequence is terminated in response to the depression.

In the eight and ninth embodiments explained above, the sheet width detection of the manually fed sheet by the width detection means allows definition of the candidate sheet sizes of the manually fed sheet, and the selection of one of the candidate sheet sizes by the selection means allows determination of the size of the recording sheet supplied from the manual sheet feeding means. Thus, when the mode setting means selects any of the automatic sheet selection mode, the multiple or two-side copying mode, the copying sequence in such modes can be executed with the sheet feeding from the manual sheet feeding means.

Also, since the designated sheet size of the manually fed sheet is memorized in the memory means, the manual sheet feeding can be continued with thus memorized sheet size.

Furthermore, since the candidate size data stored in the memory means are read and displayed on the display unit by the display control means according to a predetermined order of priority, there can be displayed a desired candidate size, among the candidate size data corresponding to the detected sheet width.

Furthermore, since the display control means reads, in succession, the candidate size data stored in the memory means and displays the data on the display unit according to an order of priority based on the width information detected by the width detecting means, a desired manual feed sheet size can be displayed as the candidate of highest priority, among the candidate size data corresponding to the detected sheet width.

Furthermore, since the display control means reads the candidate size data stored in the memory means and displays the data first on the display unit, the desired manual feed sheet size, which has been selected before, can be displayed as the candidate of the highest priority.

Furthermore, since the display control means can execute the preferential display of the candidate size data according to a disabling or enabling instruction for the preferential display control by the aforementioned instruction means, such preferential display can be selectively executed.

Consequently, there can be attained an advantage that the copying sequence in the automatic sheet selection mode, the multiple copying mode or the two-side copying mode can be properly executed even in case of manual sheet feeding.

As will be apparent from the foregoing description, the first to fourth embodiments can be advantageously applied to the seventh to ninth embodiments. Furthermore, the first to ninth embodiments can be executed in suitable combinations thereof.

Furthermore, the present invention is not limited to the foregoing embodiments, but is subjected to various modifications within the scope and spirit of the appended claims.

What is claimed is:

1. A sheet size detecting device comprising:

sheet width setting means for setting width of a recording sheet;

sheet width detecting means for releasing a first electrical signal corresponding to a set value of said sheet width setting means;

sheet length setting means for setting the length of said recording sheet;

sheet length detecting means for releasing a second electrical signal corresponding to a set value of said sheet length setting means;

sheet size detecting means for detecting the size of said sheet, based on said first and second electrical signals;

wherein said first electrical signal released by said sheet width detecting means is a continuous electrical signal designating said sheet width, and said second electrical signal released by said sheet length detecting means is an electrical signal designating regular-sized sheets contained in one of plural divided sheet length regions; and setting means for setting, in case said sheet size detecting means detects plural regular sheet sizes based on said first and second electrical signals, an order of priority of detection to said regular sheet sizes.

2. A sheet size detecting device comprising:

sheet width setting means for setting width of a recording sheet;

sheet width detecting means for releasing a first electrical signal corresponding to a set value of said sheet width setting means;

sheet length setting means for setting the length of said recording sheet;

sheet length detecting means for releasing a second electrical signal corresponding to a set value of said sheet length setting means;

sheet size detecting means for detecting the size of said sheet, based on said first and second electrical signals:

wherein said first electrical signal released by said sheet width detecting means is a continuous electrical signal designating said sheet width, and said second electrical signal released by said sheet length detecting means is an electrical signal designating regular-sized sheets contained in one of plural divided sheet length regions; and wherein said sheet size detecting means is so constructed, upon selecting plural regular sheet sizes based on said first and second electrical signals, as to effect sheet size detection according to an order of priority set in advance to said plural regular sheet sizes.

3. A sheet size detecting device according to claim 2, wherein the order of priority is set in consideration of the destination for use of the device.

4. A copying apparatus comprising:

plural container means containing recording media of predetermined sizes to be fed;

manual sheet feeding means for feeding manually fed recording media;

mode setting means for selecting and setting any of the automatic sheet selection mode, the multiple copying mode and the two-side copying mode;

width detecting means for detecting the width of the recording medium fed from said manual sheet feeding means;

sheet detection means for detecting the presence or absence of said recording medium fed from said manual sheet feeding means;

manually fed sheet size display means for displaying, on a display unit, manually feedable candidate sheet sizes, based on the width information detected by said width detecting means; and selection means for selecting one of the candidate sheet sizes displayed by said manually fed sheet size display means on said display unit;

wherein, at the setting of any of said mode by said mode setting means, the sheet size selected by said selection means is designated as the manually fed sheet size.

5. A copying apparatus according to claim 4, further comprising memory means for memorizing thus designated manually fed sheet size.

6. A copying apparatus according to claim 5, further comprising:

size memory means for memorizing the candidate size data of the manually fed recording medium, designable according to the width information detected by the width detection means; and display control means for reading and displaying the candidate size data, memorized in said size memory means, on the display unit in succession according to a predetermined order of priority of display.

7. A copying apparatus according to claim 6, wherein said display control means is adapted to read and display the candidate size data, memorized in said size memory means, on the display unit in succession, based on an order of priority according to the width information detected by the width detection means.

8. A copying apparatus according to claim 6, wherein said display control means is adapted to read the candidate size data, memorized in said size memory means, and display said data at first on the display unit.

9. A copying apparatus according to claim 8, further comprising instruction means for disabling or enabling preferential display control of the candidate size data by the display control means, wherein said display control means is adapted to effect the preferential display of the candidate size data according to the disabling or enabling instruction for the preferential display control by said instruction means.

10. A copying apparatus provided with manual sheet feeding means, comprising:

image formation control means for controlling an image forming operation;

manual input means for designating a size of copying sheet placed on said manual sheet feeding means;

setting means for setting the sheet size designated by said manual input means;

sheet detecting means for detecting whether the sheet is placed on the manual sheet feeding means; and resetting means for resetting the sheet size set by said setting means in accordance with said sheet detecting means, wherein said image formation control means controls the image forming operation in accordance with the size set by said setting input means.

11. A copying apparatus according to claim 10, wherein said manual sheet feeding means is capable of placing plural sheets.

12. A copying apparatus according to claim 10, further comprising a liquid crystal display device for displaying the sheet size.

13. A copying apparatus according to claim 10, further comprising at least one sheet feeding means, selection means for selecting one of said sheet feeding means including said manual sheet feeding means; and display means for displaying a sheet size, when said manual sheet feeding means is selected by said selection means.

14. A copying apparatus according to claim 10, further comprising at least one sheet feeding means, selection means for selecting one of said sheet feeding means including said manual sheet feeding means; and display means for displaying the sheet size regardless of the sheet feeding means selected by said selection means.

15. An image forming apparatus comprising:

detecting means for detecting a size in at least one direction of a sheet;

specifying means for specifying at least one regular sheet size based on the size detected by said detecting means;

designation means for designating, when said specifying means specifies a plurality of the regular sheet sizes, one of the specified plurality of the regular sheet sizes; and display means for displaying the specified plurality of the regular sheet sizes, when said specifying means specifies a plurality of the regular sheet sizes, wherein said designation means designates one of the displayed plurality of the regular sheet sizes based on a manual operation by an operator.

16. An image forming apparatus according to claim 15, further comprising:

memorizing means for memorizing the size designated by said designation means, and means for detecting whether sheets are present or absent, wherein content of said memorizing means is reset when it is detected that the sheets are absent.

17. An apparatus according to claim 15, wherein said specifying means is adapted to specify candidate regular sheet sizes not exceeding the size detected by said detecting means.

18. An apparatus according to claim 15, further comprising alarm means for providing an alarm in case a manual designation by an operator does not correspond to the plurality of the regular sheet sizes displayed on said display means.

19. An apparatus according to claim 15, wherein in case a manual designation by an operator does not correspond to the plurality of the regular sheet sizes displayed on said display means, said apparatus processes the sheet size as an irregular sheet size.

20. An apparatus according to claim 15, wherein said detecting means detects the sheet size manually fed to manual feeding means, in at least one direction.

21. An apparatus according to claim 20, wherein said detecting means, on which a plurality of sheets can be placed, regulates widths of the sheets.

22. An apparatus according to claim 21, further comprising a movable regulating plate for regulating the widths of placed sheets, wherein sizes of the placed sheets are detected by said detecting means on the basis of a position of said movable regulating plate.

23. An apparatus according to claim 21, further comprising plural sheet feeding means, and selection means for selecting one of said plural sheet feeding means including said manual sheet feeding means, wherein said display means is adapted to provide display only when said manual sheet feeding means is selected by said selection means.

24. An apparatus according to claim 15, wherein said apparatus controls an image forming operation on the basis of the regular sheet size designated by said designation means.

* * * * *

UNITED STATES PATENT AND TRADEMARK OFFICE

CERTIFICATE OF CORRECTION

PATENT NO. : 5,689,759
DATED : November 18, 1997
INVENTOR(S) : Keizo ISEMURA, et al.

It is certified that error appears in the above-indentified patent and that said Letters Patent is hereby corrected as shown below:

Title Page, [56], Foreign Patent Documents, delete "6--61425" and insert therefor --60-61425--.

Column 16, line 54, delete "RD," and insert therefor --RDF--.

Column 21, line 56, delete "(5)" and insert therefor --(6)--.

Column 23, line 35, delete the colon (":") and insert therefor a semicolon (";").

Column 24, line 15, delete "designable" and insert therefor --designatable--;
Line 32, delete "8" and insert therefor --6--;
Line 44, after "of", insert --a--.

Signed and Sealed this

Nineteenth Day of May, 1998

Bruce Lehman

*Attest:*

BRUCE LEHMAN

*Attesting Officer*

*Commissioner of Patents and Trademarks*